US012171290B2

(12) United States Patent
Lotti

(10) Patent No.: US 12,171,290 B2
(45) Date of Patent: Dec. 24, 2024

(54) ARTIFICIAL LASH EXTENSIONS

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 18/199,288

(22) Filed: May 18, 2023

(65) Prior Publication Data

US 2023/0284724 A1 Sep. 14, 2023

Related U.S. Application Data

(63) Continuation of application No. 17/720,222, filed on Apr. 13, 2022, which is a continuation of application No. 17/003,874, filed on Aug. 26, 2020, now Pat. No. 11,330,856, which is a continuation of application No. 16/556,518, filed on Aug. 30, 2019, now Pat. No. 11,234,472, which is a continuation of application No. 15/968,361, filed on May 1, 2018, now Pat. No. 10,660,388, which is a continuation of application No. PCT/US2017/044217, filed on Jul. 27, 2017.

(60) Provisional application No. 62/368,116, filed on Jul. 28, 2016.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | |
|---|---|---|---|
| 232,595 | A | 9/1880 | Hanisch |
| 783,924 | A | 2/1905 | Boeehm |
| 834,683 | A | 10/1906 | Severin |
| 994,619 | A | 6/1911 | Taylor |
| 1,021,063 | A | 3/1912 | Miller |
| 1,450,259 | A | 4/1923 | Charles |
| 1,657,497 | A | 1/1928 | Cichon |
| 1,831,801 | A | 11/1931 | Birk |

(Continued)

FOREIGN PATENT DOCUMENTS

| | | | |
|---|---|---|---|
| CA | 216492 | A | 3/1922 |
| CA | 2904764 | A1 | 9/2014 |

(Continued)

OTHER PUBLICATIONS

Youtube: "Volume Tweezers," Jun. 11, 2014, 20 Pages, Retrieved from URL: https://www.youtube.com/watchv=vvbDF18x2h8.

(Continued)

*Primary Examiner* — Rachel R Steitz
*Assistant Examiner* — Brianne E Kalach
(74) *Attorney, Agent, or Firm* — Lowenstein Sandler LLP

(57) ABSTRACT

An artificial lash extension system includes multiple lash extensions, each including a knotless base and clusters of two or more artificial hairs. Each of the multiple lash extensions include a first adhesive that joins the clusters to the knotless base. The multiple lash extensions attach to an underside of natural eyelashes of an eye with a second adhesive.

30 Claims, 10 Drawing Sheets

(56) References Cited

U.S. PATENT DOCUMENTS 1,897,747 A 2/1933 Birk
1,920,401 A 8/1933 Kahn
1,987,931 A 1/1935 Jacob
2,004,046 A 6/1935 Glaser et al.
2,013,011 A 9/1935 Sheldon
D101,791 S 11/1936 Rauh
2,079,256 A 5/1937 Kaiser
D129,526 S 9/1941 Hanisch
2,268,082 A 12/1941 Phillips, Sr.
2,323,595 A 7/1943 Hanisch
2,392,694 A 1/1946 Rector
2,421,432 A 6/1947 Phillips
D154,227 S 6/1949 Alvizua
D155,559 S 10/1949 Tillmann
2,618,279 A 11/1952 Reiffert
2,630,516 A 3/1953 Rausch et al.
2,812,768 A * 11/1957 Giuliano ..... A41G 5/02 132/201
D189,888 S 3/1961 Tapper
3,016,059 A 1/1962 Hutton
3,032,042 A * 5/1962 Meehan ..... A41G 5/02 132/201
3,032,342 A 5/1962 Glass
3,174,321 A 3/1965 Williams
3,245,416 A 4/1966 Aylott
3,266,500 A 8/1966 Weld
3,295,534 A 1/1967 Jess
3,306,139 A 2/1967 Brackett
3,315,689 A 4/1967 Mehron
3,339,561 A 9/1967 Brickner
3,343,552 A 9/1967 Steffen
D210,180 S 2/1968 Nathan
3,392,727 A 7/1968 Hanlon
D213,239 S 1/1969 Marlene
3,447,540 A 6/1969 Osher
3,454,015 A 7/1969 Udes
3,461,886 A 8/1969 Bau
D215,985 S 11/1969 Victor
3,478,754 A 11/1969 Martin, Jr.
3,491,775 A 1/1970 Aylott
3,516,423 A 6/1970 Seidler
3,547,135 A 12/1970 Roos
3,557,653 A 1/1971 Kim
D219,854 S 2/1971 Pearl
3,561,454 A 2/1971 O'Connell
D222,518 S 10/1971 David
3,625,229 A 12/1971 Silson
3,645,281 A 2/1972 Seidler
3,670,742 A 6/1972 Weaner
3,703,180 A 11/1972 Aylott
3,818,784 A 6/1974 McClure
3,828,803 A 8/1974 Windsor
3,833,007 A 9/1974 Jacobs
3,900,038 A 8/1975 Masters
D240,769 S 7/1976 Bowman
3,968,807 A 7/1976 Kraicer
3,970,092 A 7/1976 Nelson
3,970,992 A 7/1976 Boothroyd
3,971,392 A 7/1976 Brehmer
3,980,092 A 9/1976 Garufi
3,982,313 A 9/1976 Nelson, Jr.
4,016,889 A 4/1977 Cowles
4,018,336 A 4/1977 Aylott
4,029,111 A 6/1977 Barton
4,049,006 A 9/1977 Saunders
4,163,535 A 8/1979 Austin
4,168,713 A 9/1979 Agiotis
4,203,518 A 5/1980 Current
4,205,693 A 6/1980 Mallouf
4,225,693 A 9/1980 McCormick
4,254,772 A 3/1981 McNamee
4,254,784 A 3/1981 Nelson
4,284,092 A 8/1981 Auretta
4,296,765 A 10/1981 Bachtell
D261,601 S 11/1981 Kettlestrings
4,299,242 A * 11/1981 Choe ..... A41G 5/02 132/53
4,360,033 A 11/1982 Schmehling
D269,820 S 7/1983 Bisson
4,395,824 A 8/1983 Puro
D270,551 S 9/1983 Thayer
4,458,701 A 7/1984 Holland
4,509,539 A 4/1985 Alfieri
D280,354 S 8/1985 Bakic
D281,259 S 11/1985 Hensley
D281,825 S 12/1985 Bakic
4,600,029 A 7/1986 Ueberschaar
4,697,856 A 10/1987 Abraham
4,739,777 A 4/1988 Nelson
4,761,028 A 8/1988 Dulebohn
4,767,492 A 8/1988 Fukusima
D298,070 S 10/1988 Ferrari
4,784,713 A 11/1988 Van Nieulande
D299,561 S 1/1989 Bakic
D301,371 S 5/1989 Kaprelian
D302,602 S 8/1989 Bakic
4,865,057 A 9/1989 Braun
4,934,387 A 6/1990 Megna
4,964,428 A 10/1990 Lamatrice
D314,066 S 1/1991 Bakic
5,003,467 A 3/1991 Donaldson et al.
5,010,914 A 4/1991 Merges
D318,346 S 7/1991 Bakic
5,033,626 A 7/1991 Platti
5,072,745 A 12/1991 Cheh
5,082,010 A 1/1992 Skaryd
5,117,846 A 6/1992 Finamore
D328,246 S 7/1992 Nottingham
5,154,195 A 10/1992 Irisawa
D342,671 S 12/1993 Elliott
D343,340 S 1/1994 Frye, Jr.
5,307,826 A 5/1994 Iosilevich
D348,219 S 6/1994 Goldberg
5,322,166 A 6/1994 Crowther
5,368,052 A 11/1994 Finamore
5,377,700 A 1/1995 Harris
D358,312 S 5/1995 Keenan
D358,908 S 5/1995 Rawski
5,411,775 A 5/1995 Wilson
5,419,345 A 5/1995 Kadymir
D359,583 S 6/1995 Abbo
D368,495 S 4/1996 Rypinski
5,533,529 A 7/1996 Ohno
5,547,529 A 8/1996 Woolf
D373,726 S 9/1996 Power
5,571,543 A 11/1996 Song
D379,923 S 6/1997 De Baschmakoff
D380,616 S 7/1997 Leslie
D382,198 S 8/1997 Mulhauser
D386,808 S 11/1997 Litton
D387,483 S 12/1997 Sloan
D388,549 S 12/1997 Mouyiaris
5,746,232 A 5/1998 Martin
5,765,571 A 6/1998 Dinnel
D397,040 S 8/1998 Bakic
5,813,418 A 9/1998 Pillars
D403,922 S 1/1999 Terracciano
D404,531 S 1/1999 Bakic
5,894,846 A 4/1999 Gang
5,896,996 A 4/1999 Chuang
D411,649 S 6/1999 Bakic
5,944,028 A 8/1999 Gebhard
D418,018 S 12/1999 Winsted
D418,253 S 12/1999 Bakic
6,003,467 A 12/1999 Shelton-Ferrell
6,016,814 A 1/2000 Elliott
6,019,107 A 2/2000 Overmyer
6,029,674 A 2/2000 Han
6,032,609 A 3/2000 Luoma
6,035,861 A 3/2000 Copello
6,092,291 A 7/2000 Cendoma
6,109,274 A 8/2000 Ingersoll
D437,086 S 1/2001 Dickert
6,174,321 B1 1/2001 Webb

(56) References Cited

U.S. PATENT DOCUMENTS

| | | | |
|---|---|---|---|
| 6,182,839 | B1 | 2/2001 | Robbins |
| D442,304 | S | 5/2001 | Huang |
| 6,230,715 | B1 | 5/2001 | Cho |
| D443,471 | S | 6/2001 | Lillelund |
| 6,247,476 | B1 | 6/2001 | Sartena |
| 6,257,250 | B1 | 7/2001 | Sartena |
| 6,265,010 | B1 | 7/2001 | Franco |
| D448,927 | S | 10/2001 | Vazquez |
| 6,302,115 | B1 | 10/2001 | Sartena |
| 6,308,716 | B1 | 10/2001 | Han |
| D452,151 | S | 12/2001 | Scott |
| 6,325,071 | B1 | 12/2001 | Butcher |
| D454,981 | S | 3/2002 | Lamagna |
| D456,077 | S | 4/2002 | Etter |
| D456,097 | S | 4/2002 | Lamagna |
| D458,413 | S | 6/2002 | Boilen |
| 6,405,736 | B2 | 6/2002 | Townsend |
| 6,439,406 | B1 | 8/2002 | Duhon |
| D463,280 | S | 9/2002 | Brozell |
| D463,744 | S | 10/2002 | Brozell |
| D464,565 | S | 10/2002 | Weinstein |
| D464,877 | S | 10/2002 | Weinstein |
| 6,471,515 | B2 | 10/2002 | Feuer |
| D467,800 | S | 12/2002 | Chen |
| 6,494,212 | B1 | 12/2002 | Yamakoshi |
| 6,530,379 | B2 | 3/2003 | Iosilevich |
| D472,675 | S | 4/2003 | Lamagna |
| D472,810 | S | 4/2003 | Gelardi |
| D473,106 | S | 4/2003 | Scherer |
| 6,561,197 | B2 | 5/2003 | Harrison |
| 6,567,640 | B2 | 5/2003 | Ishikawa |
| D475,616 | S | 6/2003 | Lambrecht |
| 6,581,609 | B2 | 6/2003 | Ott |
| D479,365 | S | 9/2003 | Todeschini |
| D480,864 | S | 10/2003 | Sayers |
| D481,946 | S | 11/2003 | Nicholson |
| D481,952 | S | 11/2003 | Orsomando |
| D482,495 | S | 11/2003 | Jackel-Marken |
| D482,928 | S | 12/2003 | Liu |
| D482,934 | S | 12/2003 | Liu |
| D483,232 | S | 12/2003 | Liu |
| D483,633 | S | 12/2003 | Jansson |
| D483,909 | S | 12/2003 | Todeschini |
| D485,359 | S | 1/2004 | McMichael |
| 6,688,315 | B1 | 2/2004 | Harrison |
| 6,691,714 | B1 | 2/2004 | Yaguchi |
| 6,708,696 | B2 | 3/2004 | Ferguson |
| D488,353 | S | 4/2004 | Govrik |
| D488,618 | S | 4/2004 | Wekstein |
| D490,932 | S | 6/2004 | Mammone |
| D491,336 | S | 6/2004 | Cecere |
| D495,834 | S | 9/2004 | Todeschini |
| D496,759 | S | 9/2004 | Rodriguez |
| 6,789,551 | B2 | 9/2004 | Iosilevich |
| 6,820,625 | B2 | 11/2004 | Park |
| D501,580 | S | 2/2005 | Sugawara |
| D506,573 | S | 6/2005 | de Grandcourt |
| D507,678 | S | 7/2005 | Lamagna |
| 6,935,348 | B2 | 8/2005 | Gold |
| 6,935,349 | B2 | 8/2005 | Nicot |
| D509,942 | S | 9/2005 | Connolly |
| D512,913 | S | 12/2005 | Gauthier |
| 6,973,931 | B1 | 12/2005 | King |
| 6,981,814 | B2 | 1/2006 | Geardino |
| D515,242 | S | 2/2006 | Cho |
| D515,742 | S | 2/2006 | Anderson et al. |
| D516,247 | S | 2/2006 | Merheje |
| 7,000,775 | B2 | 2/2006 | Gelardi |
| 7,036,518 | B2 | 5/2006 | Park |
| D522,376 | S | 6/2006 | Hales |
| 7,128,213 | B2 | 10/2006 | Tung et al. |
| D532,891 | S | 11/2006 | Buthier |
| D533,650 | S | 12/2006 | Ohta |
| 7,147,127 | B2 | 12/2006 | Lepke et al. |
| D534,426 | S | 1/2007 | Bakic |
| 7,159,720 | B2 | 1/2007 | Pearson |
| 7,168,432 | B1 | 1/2007 | Brumfield |
| D537,208 | S | 2/2007 | Shaljian |
| D540,112 | S | 4/2007 | Nichols |
| D543,662 | S | 5/2007 | Bivona |
| D543,663 | S | 5/2007 | Bivona et al. |
| D543,815 | S | 6/2007 | Metcalf |
| D543,850 | S | 6/2007 | Legros |
| D544,148 | S | 6/2007 | Bivona |
| D544,202 | S | 6/2007 | Markfelder |
| D545,396 | S | 6/2007 | Casey |
| 7,228,863 | B2 | 6/2007 | Dumler |
| D546,002 | S | 7/2007 | Bowen |
| D547,940 | S | 8/2007 | Sandy |
| D559,457 | S | 1/2008 | Garland |
| D561,045 | S | 2/2008 | Lee |
| D561,357 | S | 2/2008 | Leclercq |
| D561,942 | S | 2/2008 | Khubani |
| 7,331,351 | B1 | 2/2008 | Asai |
| D563,157 | S | 3/2008 | Bouveret |
| D563,616 | S | 3/2008 | Lynde |
| D563,728 | S | 3/2008 | Welch, III |
| 7,343,921 | B2 | 3/2008 | Salinas |
| D569,041 | S | 5/2008 | Azoulay |
| D569,553 | S | 5/2008 | Cho |
| 7,374,048 | B2 | 5/2008 | Mazurek |
| D571,543 | S | 6/2008 | Sungadi |
| D573,306 | S | 7/2008 | Yoo |
| D573,308 | S | 7/2008 | Wittke-Kothe |
| D575,904 | S | 8/2008 | Iqbal |
| D579,059 | S | 10/2008 | Chan |
| 7,469,701 | B1 | 12/2008 | Bernard |
| D584,449 | S | 1/2009 | Shaljian |
| D587,529 | S | 3/2009 | Pratt |
| D588,746 | S | 3/2009 | Ross |
| 7,501,178 | B2 | 3/2009 | Sato |
| D591,599 | S | 5/2009 | Okin |
| D592,917 | S | 5/2009 | Jalet et al. |
| D592,923 | S | 5/2009 | Konopka |
| 7,533,676 | B2 | 5/2009 | Sthair |
| D595,054 | S | 6/2009 | Whitaker |
| 7,543,718 | B2 | 6/2009 | Simon |
| D600,441 | S | 9/2009 | Estrada |
| D602,354 | S | 10/2009 | Dibnah |
| 7,600,519 | B2 | 10/2009 | Dinh |
| D604,579 | S | 11/2009 | Robinson |
| 7,610,921 | B2 | 11/2009 | Gold |
| D605,514 | S | 12/2009 | Weber |
| 7,637,265 | B2 | 12/2009 | Funatsu et al. |
| D607,332 | S | 1/2010 | Huntington |
| D615,290 | S | 5/2010 | Heffner |
| D617,187 | S | 6/2010 | Murray |
| D617,943 | S | 6/2010 | Bouix |
| D618,078 | S | 6/2010 | Cripps |
| 7,748,391 | B2 | 7/2010 | Vance |
| D627,103 | S | 11/2010 | Cho |
| 7,836,899 | B2 | 11/2010 | Sugai |
| D631,606 | S | 1/2011 | Chen |
| 7,896,192 | B2 | 3/2011 | Conley |
| D636,127 | S | 4/2011 | Allison et al. |
| D638,733 | S | 5/2011 | Sullivan |
| 7,938,128 | B2 | 5/2011 | Gueret |
| D639,196 | S | 6/2011 | Sullivan |
| D640,005 | S | 6/2011 | Lee |
| D640,834 | S | 6/2011 | Chen |
| D641,106 | S | 7/2011 | Williams |
| 8,015,980 | B2 | 9/2011 | Rabe |
| 8,025,065 | B2 | 9/2011 | Guliker |
| 8,042,553 | B2 | 10/2011 | Paris |
| D647,799 | S | 11/2011 | Dunwoody |
| 8,061,367 | B2 | 11/2011 | Rabe |
| D650,669 | S | 12/2011 | Dunwoody |
| D650,670 | S | 12/2011 | Dunwoody |
| D651,082 | S | 12/2011 | Dunwoody |
| 8,113,218 | B2 † | 2/2012 | Nguyen |
| 8,127,774 | B2 | 3/2012 | Dinh |
| D657,496 | S | 4/2012 | Flatt |
| D657,696 | S | 4/2012 | Floyd |
| D659,330 | S | 5/2012 | Davis |

(56) References Cited

U.S. PATENT DOCUMENTS

| | | | |
|---|---|---|---|
| 8,171,943 | B2 | 5/2012 | Hamano |
| 8,186,361 | B2 | 5/2012 | Hampton |
| D661,185 | S | 6/2012 | Battat |
| D661,599 | S | 6/2012 | Floyd |
| 8,191,556 | B2 | 6/2012 | Betts |
| 8,196,591 | B2 | 6/2012 | Lee |
| 8,205,761 | B2 | 6/2012 | Stull, Sr |
| D663,113 | S | 7/2012 | Simms |
| D664,011 | S | 7/2012 | Affonso |
| 8,225,800 | B2 | 7/2012 | Byme |
| D669,223 | S | 10/2012 | Lee |
| D670,030 | S | 10/2012 | Nguyen |
| D673,325 | S | 12/2012 | Martines |
| 8,342,186 | B2 | 1/2013 | Freelove |
| 8,347,896 | B2 | 1/2013 | Liao |
| D679,590 | S | 4/2013 | Stull, Sr. |
| D679,591 | S | 4/2013 | Stull, Sr. |
| D679,592 | S | 4/2013 | Stull, Sr. |
| D679,595 | S | 4/2013 | Stull, Sr. |
| D679,596 | S | 4/2013 | Stull, Sr. |
| D682,103 | S | 5/2013 | Jedlicka |
| D682,688 | S | 5/2013 | Murray |
| 8,434,500 | B2 | 5/2013 | Alex |
| D686,495 | S | 7/2013 | Murray |
| D690,419 | S | 9/2013 | Porat |
| 8,528,571 | B2 | 9/2013 | Costa |
| 8,567,640 | B1 | 10/2013 | Johnson-Lofton |
| 8,578,946 | B2 | 11/2013 | Ellery |
| 8,590,543 | B2 | 11/2013 | Goff et al. |
| 8,596,284 | B2 | 12/2013 | Byrne |
| 8,616,223 | B2 | 12/2013 | Rabe |
| D698,078 | S | 1/2014 | Purizhansky |
| 8,657,170 | B2 | 2/2014 | Martinez |
| D700,799 | S | 3/2014 | Ludeman |
| 8,672,377 | B2 | 3/2014 | Ina |
| D702,510 | S | 4/2014 | Segal |
| 8,701,685 | B2 | 4/2014 | Chipman |
| D707,392 | S | 6/2014 | Yu |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori |
| D714,494 | S | 9/2014 | Vasquez |
| 8,826,919 | B2 | 9/2014 | Dinh |
| D716,498 | S | 10/2014 | Wolff |
| D717,038 | S | 11/2014 | Lee |
| D717,536 | S | 11/2014 | Gupta |
| D718,498 | S | 11/2014 | Gu |
| 8,875,718 | B2 | 11/2014 | Dinh |
| 8,881,741 | B1 | 11/2014 | Mattson |
| 8,881,744 | B2 | 11/2014 | Mckinstry |
| D718,901 | S | 12/2014 | Parker |
| 8,939,159 | B2 | 1/2015 | Yeo |
| 8,967,158 | B2 | 3/2015 | Sanbonmatsu |
| 9,004,076 | B2 | 4/2015 | Le |
| 9,004,299 | B2 | 4/2015 | Hardin |
| 9,027,568 | B2 | 5/2015 | Lee |
| 9,044,076 | B2 | 6/2015 | Temple |
| 9,078,480 | B2 | 7/2015 | Beschta |
| 9,107,461 | B2 | 8/2015 | Martins |
| D738,579 | S | 9/2015 | Owens |
| D738,611 | S | 9/2015 | Gupta |
| 9,149,083 | B1 | 10/2015 | Dinh |
| 9,155,345 | B2 | 10/2015 | Nisim |
| 9,179,722 | B2 | 11/2015 | Le |
| 9,185,943 | B2 | 11/2015 | Merszei |
| D746,046 | S | 12/2015 | Lee |
| D746,514 | S | 12/2015 | Lambridis |
| 9,215,901 | B1 | 12/2015 | Schroeder |
| 9,254,012 | B2 | 2/2016 | Pham |
| D751,904 | S | 3/2016 | Landrum |
| 9,277,777 | B2 | 3/2016 | Lee |
| 9,284,111 | B2 | 3/2016 | Huang |
| D753,455 | S | 4/2016 | Hyma |
| D753,881 | S | 4/2016 | Hussain |
| 9,314,085 | B2 | 4/2016 | Hatch |
| D755,577 | S | 5/2016 | Segal |
| D757,274 | S | 5/2016 | Gelb |
| D758,009 | S | 5/2016 | Berkos |
| 9,339,072 | B2 | 5/2016 | Kenna |
| 9,351,752 | B2 | 5/2016 | Slavin |
| D761,489 | S | 7/2016 | Krakovszki |
| D762,433 | S | 8/2016 | Yang |
| D764,688 | S | 8/2016 | Robinson |
| D765,909 | S | 9/2016 | Marchica |
| 9,433,421 | B2 | 9/2016 | Ueno et al. |
| 9,439,465 | B2 | 9/2016 | Ott |
| 9,451,800 | B2 | 9/2016 | Dinh |
| 9,456,646 | B2 | 10/2016 | Calina |
| 9,462,837 | B2 | 10/2016 | Ngo |
| 9,468,245 | B2 | 10/2016 | Woods |
| D771,318 | S | 11/2016 | Taff |
| 9,486,025 | B1 | 11/2016 | Dinh |
| 9,504,285 | B2 | 11/2016 | Lin |
| D773,915 | S | 12/2016 | Barakat |
| D775,270 | S | 12/2016 | Moffat |
| 9,516,908 | B2 | 12/2016 | Miyatake |
| 9,565,883 | B2 | 2/2017 | Dinh |
| D780,994 | S | 3/2017 | Hardwick |
| 9,596,898 | B2 | 3/2017 | Seawright |
| D783,899 | S | 4/2017 | Roh |
| D783,901 | S | 4/2017 | Kim |
| D784,615 | S | 4/2017 | Choi |
| 9,622,527 | B2 | 4/2017 | Nguyen |
| D788,556 | S | 6/2017 | James |
| 9,730,481 | B2 | 8/2017 | Uresti |
| D796,582 | S | 9/2017 | Beard |
| D800,966 | S | 10/2017 | Silva |
| 9,815,655 | B2 | 11/2017 | Crapet et al. |
| D805,135 | S | 12/2017 | Beard |
| D806,315 | S | 12/2017 | Hardwick |
| 9,833,028 | B2 | 12/2017 | Jang |
| 9,848,661 | B2 | 12/2017 | Harris |
| 9,848,662 | B2 | 12/2017 | Dinh |
| D810,534 | S | 2/2018 | Liu |
| D810,543 | S | 2/2018 | Astradsson |
| D811,872 | S | 3/2018 | Wu |
| D812,303 | S | 3/2018 | Pascullo |
| D814,107 | S | 3/2018 | Lotti |
| D814,260 | S | 4/2018 | Dhubb |
| 9,930,919 | B1 | 4/2018 | Branker |
| 9,946,169 | B2 | 4/2018 | Endo |
| D817,132 | S | 5/2018 | Yang |
| D819,891 | S | 6/2018 | Kenig et al. |
| 9,993,373 | B2 | 6/2018 | Nassif |
| D823,538 | S | 7/2018 | Ruggaber |
| D823,683 | S | 7/2018 | Caldwell |
| D825,333 | S | 8/2018 | Ozamiz |
| D826,019 | S | 8/2018 | Keehner |
| D828,013 | S | 9/2018 | van Wijngaarden |
| D828,014 | S | 9/2018 | van Wijngaarden |
| D828,629 | S | 9/2018 | Hussain |
| D829,381 | S | 9/2018 | Kim |
| D830,170 | S | 10/2018 | Holmes |
| D832,701 | S | 11/2018 | Oates |
| D832,702 | S | 11/2018 | Oates |
| D835,465 | S | 12/2018 | Son |
| D836,432 | S | 12/2018 | Riedel |
| 10,149,528 | B2 | 12/2018 | Erickson |
| D836,943 | S | 1/2019 | Klieman |
| D837,653 | S | 1/2019 | Meranus |
| D840,104 | S | 2/2019 | Hussain |
| 10,264,837 | B2 | 4/2019 | Park |
| D847,631 | S | 5/2019 | Villbrandt |
| D847,632 | S | 5/2019 | Villbrandt |
| D848,795 | S | 5/2019 | Butler |
| D850,715 | S | 6/2019 | Lotti |
| D852,412 | S | 6/2019 | Grund |
| 10,362,823 | B1 | 7/2019 | Hill |
| D862,796 | S | 10/2019 | Jin Kim |
| D863,419 | S | 10/2019 | Oguma |
| D863,679 | S | 10/2019 | Lotti |

(56) References Cited

U.S. PATENT DOCUMENTS 10,433,607 B2 10/2019 Ahn
D867,664 S 11/2019 Lotti
D867,668 S 11/2019 Lotti
10,479,566 B2 11/2019 Doyle
D871,673 S 12/2019 Qureshi
10,532,861 B2 1/2020 Kimmel
D877,416 S 3/2020 Lotti
D884,273 S 5/2020 Liu
10,638,826 B2 5/2020 Lotti
10,660,388 B2 5/2020 Lotti
D887,664 S 6/2020 Liao et al.
D890,430 S 7/2020 Lotti
10,721,984 B2 7/2020 Lotti
D895,201 S 9/2020 Lotti
D895,958 S 9/2020 Guo
10,791,782 B2 10/2020 Nakamura
10,892,048 B2 1/2021 Reddy et al.
D909,680 S 2/2021 Hussain
D914,965 S 3/2021 Lotti
D917,153 S 4/2021 Denei
D918,475 S 5/2021 Hu
D920,400 S 5/2021 Saito
D920,465 S 5/2021 Bould
D926,372 S 7/2021 Liang
D930,788 S 9/2021 Roth
D932,101 S 9/2021 Davis
D937,482 S 11/2021 Kim
11,172,749 B2 11/2021 Lotti
11,219,260 B2 1/2022 Lotti
11,234,472 B2 2/2022 Lotti
11,253,020 B2 2/2022 Lotti
D952,258 S 5/2022 Lotti
11,330,855 B2 5/2022 Lotti
11,330,856 B2 5/2022 Lotti
D955,635 S 6/2022 Lotti
D955,645 S 6/2022 Lotti
D961,845 S 8/2022 Wang
11,432,608 B2 9/2022 Lotti
11,446,017 B2 9/2022 Klassen et al.
11,466,182 B2 10/2022 Lotti
D971,505 S 11/2022 Lotti
D971,506 S 11/2022 Lotti
D972,218 S 12/2022 Liu
D980,521 S 3/2023 Lotti
D984,050 S 4/2023 Lotti
D987,891 S 5/2023 Lotti
D995,914 S 8/2023 Lotti
D1,006,319 S 11/2023 Lotti
D1,008,558 S 12/2023 Liu
11,832,710 B2 12/2023 Lotti
D1,013,277 S 1/2024 Lotti
2001/0023699 A1 9/2001 Matthews
2001/0035192 A1 11/2001 Townsend
2001/0037813 A1 11/2001 Ra
2002/0056465 A1 5/2002 Shin
2002/0094507 A1 7/2002 Feuer
2002/0103421 A1 8/2002 Putrino et al.
2002/0114657 A1 8/2002 Gueret
2002/0127514 A1 9/2002 Dietrich
2002/0198597 A1 12/2002 Godfrey
2003/0005941 A1 1/2003 Iosilevich
2003/0111467 A1 6/2003 Norman
2003/0155317 A1 8/2003 McNeeley
2003/0226571 A1 12/2003 Rahman
2004/0011371 A1 1/2004 Harrison
2004/0011372 A1 1/2004 Park
2004/0051327 A1 3/2004 Yoon
2004/0079382 A1 4/2004 Profitt-Campbell
2004/0168696 A1 9/2004 Cox
2004/0173233 A1 9/2004 Tokko
2004/0211436 A1 10/2004 Knight
2005/0061341 A1† 3/2005 Choe
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0028040 A1 2/2006 Cohen et al.
2006/0065280 A1 3/2006 Cheung
2006/0065281 A1 3/2006 Kim
2006/0081267 A1 4/2006 Kuptiz
2006/0096609 A1 5/2006 Nwokola
2006/0124658 A1 6/2006 Coe
2006/0129187 A1 6/2006 Cho
2006/0142693 A1 6/2006 Kahen
2006/0175853 A1 8/2006 Anderson
2006/0180168 A1 8/2006 Dinnel
2006/0180171 A1 8/2006 Kim
2006/0266376 A1 11/2006 Basso
2007/0023062 A1 2/2007 McKinstry
2007/0050207 A1 3/2007 Merszei
2007/0084749 A1 4/2007 Demelo
2007/0157941 A1 7/2007 Awad
2007/0157944 A1 7/2007 Catron
2007/0172264 A1 7/2007 An
2007/0199571 A1 8/2007 McCulloch
2007/0221240 A1 9/2007 Junsuh Lee
2007/0227550 A1 10/2007 Merszei
2007/0272263 A1 11/2007 Gold
2007/0272264 A1* 11/2007 Byrne ..... A41G 5/02
206/581
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita
2009/0028625 A1 1/2009 Bonneyrat
2009/0071490 A1 3/2009 Sthair
2009/0071492 A1 3/2009 Oh
2009/0178689 A1 7/2009 Navarro
2009/0217936 A1 9/2009 Sato
2009/0217939 A1 9/2009 Rabe
2009/0223534 A1 9/2009 Green
2009/0241973 A1 10/2009 Hampton
2009/0241979 A1 10/2009 Navarro
2009/0255547 A1 10/2009 Starks
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie
2010/0170526 A1* 7/2010 Nguyen ..... A41G 5/02
132/201
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim
2011/0278869 A1 11/2011 Lee
2011/0290271 A1 12/2011 Rabe
2011/0290937 A1 12/2011 Salkeld
2012/0009002 A1 1/2012 Lo et al.
2012/0037177 A1 2/2012 Teater Makinen
2012/0055499 A1 3/2012 Sanbonmatsu
2012/0160258 A1 6/2012 Cruz et al.
2012/0160259 A1 6/2012 Nguyen
2012/0174939 A1 7/2012 Starks
2012/0180804 A1 7/2012 Hochi
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler

(56) References Cited

U.S. PATENT DOCUMENTS

2013/0042884 A1 2/2013 Wilkinson
2013/0110032 A1 5/2013 Luzon
2013/0152960 A1 6/2013 Pays et al.
2013/0160783 A1 6/2013 Ahn
2013/0167855 A1 7/2013 Kupitz
2013/0167858 A1 7/2013 Lee
2013/0213431 A1 8/2013 Geva et al.
2013/0255706 A1 10/2013 Dinh
2013/0276807 A1 10/2013 Teater Makinen
2013/0298931 A1 11/2013 Samain
2013/0306089 A1 11/2013 Araujo Costa
2013/0306094 A1 11/2013 West
2013/0312781 A1 11/2013 Murphy
2013/0312782 A1 11/2013 Kindall
2013/0320025 A1 12/2013 Mazzetta
2013/0333714 A1 12/2013 Merszei
2014/0011372 A1 1/2014 Kato
2014/0060559 A1 3/2014 Lin
2014/0069451 A1 3/2014 Hwang
2014/0083447 A1 3/2014 Rabe
2014/0110304 A1 4/2014 Wu
2014/0116456 A1 5/2014 Palmer-Rogers
2014/0135914 A1 5/2014 Conant
2014/0216488 A1 8/2014 Dinh
2014/0332025 A1 11/2014 Kim
2015/0020840 A1 1/2015 Rabe
2015/0075549 A1 3/2015 Lee
2015/0114421 A1 4/2015 Pham
2015/0114422 A1 4/2015 Abraham
2015/0114423 A1* 4/2015 Sanbonmatsu ..... A41G 5/02 132/201
2015/0128986 A1 5/2015 Stookey
2015/0136162 A1 5/2015 Brouillet
2015/0173442 A1 6/2015 Raouf
2015/0181967 A1 7/2015 Dinh
2015/0181968 A1 7/2015 Uresti
2015/0201691 A1 7/2015 Palmer-Rogers
2015/0201692 A1 7/2015 Hansen
2015/0216246 A1 8/2015 Ahn
2015/0230884 A1 8/2015 McDonald et al.
2015/0351467 A1 12/2015 Simoes
2016/0016702 A1 1/2016 Siskindovich
2016/0037847 A1 2/2016 Tavakoli
2016/0037848 A1 2/2016 Lee
2016/0050996 A1 2/2016 Kwon
2016/0058087 A1 3/2016 Jang et al.
2016/0058088 A1 3/2016 Le
2016/0088889 A1 3/2016 Kettavong
2016/0135531 A1 5/2016 Ezechukwu
2016/0166039 A1 6/2016 Luu
2016/0174645 A1 6/2016 Goldner
2016/0192724 A1 7/2016 Scott
2016/0192725 A1 7/2016 Merszei
2016/0206031 A1 7/2016 Stoka
2016/0219959 A1 8/2016 Chipman
2016/0286881 A1 10/2016 Ko
2016/0324241 A2 11/2016 Lee
2016/0324242 A1 11/2016 Hansen
2016/0345648 A1 12/2016 Miniello
2016/0353821 A1 12/2016 Calina
2016/0353861 A1 12/2016 Carey
2017/0000204 A1 1/2017 Wibowo
2017/0006947 A1 1/2017 Uresti
2017/0020219 A1 1/2017 Beschta
2017/0049172 A1 2/2017 Ahn
2017/0049173 A1* 2/2017 Dinh ..... A41G 5/02
2017/0055615 A1 3/2017 Crocilla
2017/0079356 A1 3/2017 Dinh
2017/0079357 A1 3/2017 Dinh
2017/0079358 A1 3/2017 Dinh
2017/0112214 A1 4/2017 Ahn
2017/0112215 A1 4/2017 Dinh
2017/0112264 A1 4/2017 Park
2017/0127743 A1 5/2017 Nakamura
2017/0150763 A1 6/2017 Schroeder
2017/0208885 A1 7/2017 Alex
2017/0231309 A1 8/2017 Han
2017/0258163 A1 9/2017 Uresti
2017/0265550 A1 9/2017 Han
2017/0311667 A1 11/2017 Passariello
2017/0340041 A1 11/2017 Nguyen
2017/0347731 A1 12/2017 Chipman
2017/0358245 A1 12/2017 Dana
2017/0360134 A1 12/2017 Crocilla
2017/0360135 A1 12/2017 Ahn
2017/0360136 A1 12/2017 Ferrier
2018/0065779 A1 3/2018 Chiba
2018/0098591 A1 4/2018 Leeflang
2018/0160755 A1 6/2018 Hansen
2018/0235299 A1 8/2018 Stoka
2018/0242671 A1 8/2018 Merszei
2018/0242672 A1 8/2018 Lotti
2018/0242715 A1 8/2018 Lotti
2018/0352885 A1 12/2018 Kim
2018/0352886 A1 12/2018 Schroeder
2019/0133227 A1 5/2019 Le
2019/0191851 A1 6/2019 Esposito
2019/0254373 A1 8/2019 Kim
2019/0254374 A1 8/2019 Schroeder
2020/0093211 A1 3/2020 Lee
2020/0196694 A1 6/2020 Lotti
2020/0260839 A1 8/2020 Lotti
2020/0323324 A1 10/2020 Chang
2020/0323325 A1 10/2020 Kim et al.
2021/0030140 A1 2/2021 Chico
2021/0337949 A1 11/2021 Ardin
2022/0160094 A1 5/2022 Lyons et al.

FOREIGN PATENT DOCUMENTS

CN 102355833 A 2/2012
CN 302315323 2/2013
CN 102975141 A 3/2013
CN 103027410 A 4/2013
CN 103717108 A 4/2014
CN 103734961 A 4/2014
CN 203897379 U 10/2014
CN 303086463 1/2015
CN 104363790 A 2/2015
CN 204191855 U 3/2015
CN 105188439 A 12/2015
CN 205274180 U 6/2016
CN 304049505 S 2/2017
CN 304049506 S 2/2017
CN 106983203 A 7/2017
CN 304310042 S 10/2017
CN 304329374 S 10/2017
CN 304329375 S 10/2017
CN 304382151 S 12/2017
CN 304452297 1/2018
CN 304497372 S 2/2018
CN 207084233 U 3/2018
CN 304777737 S 8/2018
CN 304859863 S 10/2018
CN 304859864 S 10/2018
CN 305599881 S 2/2020
CN 305719777 4/2020
CN 305729159 S 4/2020
CN 305738664 4/2020
CN 111418982 A 7/2020
CN 305916370 7/2020
DE 950232 C 10/1956
EM 006381257-0001 4/2019
EM 006381257-0002 4/2019
EM 006381257-0003 4/2019
EP 1839526 A1 10/2007
EP 1839526 B1 7/2009
EP 006381257 10/2014
FR 569600 A 4/1924
FR 1435971 A 4/1966
FR 1539430 A 9/1968
FR 2897760 A1 8/2007
GB 190218723 A 11/1902
GB 102106 A 11/1916

(56) References Cited

FOREIGN PATENT DOCUMENTS

| | | | |
|---|---|---|---|
| GB | 1021063 | A | 2/1966 |
| GB | 1042020 | A | 9/1966 |
| GB | 1263815 | A | 2/1972 |
| GB | 1272616 | A | 5/1972 |
| GB | 1307107 | A | 2/1973 |
| GB | 2369712 | B | 3/2004 |
| GB | 2450250 | A | 12/2008 |
| GB | 2458230 | A | 9/2009 |
| GB | 2458230 | B | 5/2010 |
| GB | 2516622 | A | 2/2015 |
| GB | 6024289 | | 12/2017 |
| JP | S471395 | U | 8/1972 |
| JP | S4721880 | U | 11/1972 |
| JP | S484711 | U | 1/1973 |
| JP | S484711 | Y1 | 2/1973 |
| JP | S486937 | Y1 | 2/1973 |
| JP | 48007948 | B | 3/1973 |
| JP | S4833591 | U | 4/1973 |
| JP | S4993157 | A | 9/1974 |
| JP | S5383862 | A | 7/1978 |
| JP | 3101488 | U | 6/2004 |
| JP | 2005146500 | A | 6/2005 |
| JP | 2007222271 | A | 9/2007 |
| JP | 2009040718 | A | 2/2009 |
| JP | 3155628 | U | 11/2009 |
| JP | 3157680 | U | 2/2010 |
| JP | 2010099141 | A | 5/2010 |
| JP | 2010137329 | A | 6/2010 |
| JP | 2011500979 | A | 1/2011 |
| JP | 2011106066 | A | 6/2011 |
| JP | 2011122288 | A | 6/2011 |
| JP | 3170596 | U | 9/2011 |
| JP | 2011177395 | A | 9/2011 |
| JP | 3175232 | U | 4/2012 |
| JP | 2015105447 | A | 6/2015 |
| JP | 5823118 | B2 | 11/2015 |
| JP | 3201846 | U | 1/2016 |
| JP | 2016027220 | A | 2/2016 |
| JP | 2016510841 | A | 4/2016 |
| JP | 5955355 | B2 | 7/2016 |
| JP | 2016163699 | A | 9/2016 |
| JP | 2017012047 | A | 1/2017 |
| JP | 6130571 | B1 | 5/2017 |
| JP | 2018076626 | A | 5/2018 |
| JP | 2019044277 | A | 3/2019 |
| JP | 2019094588 | A | 6/2019 |
| JP | 2019522125 | A | 8/2019 |
| JP | 1671784 | S | 11/2020 |
| JP | 2021151399 | A | 9/2021 |
| KR | 200165452 | Y1 | 2/2000 |
| KR | 200171517 | Y1 | 3/2000 |
| KR | 200240234 | Y1 | 10/2001 |
| KR | 200260653 | Y1 | 1/2002 |
| KR | 20020065306 | A | 8/2002 |
| KR | 200350229 | Y1 | 5/2004 |
| KR | 100450341 | B1 | 10/2004 |
| KR | 200367525 | Y1 | 11/2004 |
| KR | 200369937 | Y1 | 12/2004 |
| KR | 200394275 | Y1 | 9/2005 |
| KR | 200395554 | Y1 | 9/2005 |
| KR | 20060010717 | A | 2/2006 |
| KR | 200439673 | Y1 | 4/2008 |
| KR | 20090010717 | A | 1/2009 |
| KR | 20090010717 | U | 10/2009 |
| KR | 20100112249 | A | 10/2010 |
| KR | 20110113819 | A | 10/2011 |
| KR | 101234507 | B1 | 2/2013 |
| KR | 20130082427 | A | 7/2013 |
| KR | 101336422 | B1 | 12/2013 |
| KR | 101392845 | B1 | 5/2014 |
| KR | 101396272 | * | 5/2014 |
| KR | 101509029 | B1 | 4/2015 |
| KR | 20150033455 | A | 4/2015 |
| KR | 101566166 | B1 | 11/2015 |
| KR | 20150140672 | A | 12/2015 |
| KR | 20160090493 | A | 8/2016 |
| KR | 300906653 | | 5/2017 |
| KR | 101829167 | B1 | 2/2018 |
| KR | 20190035787 | A | 4/2019 |
| PL | 230008 | B1 | 9/2018 |
| RU | 2417719 | C1 | 5/2011 |
| RU | 2419364 | C2 | 5/2011 |
| RU | 2423058 | C1 | 7/2011 |
| RU | 2558482 | C1 | 8/2015 |
| RU | 156273 | U1 | 11/2015 |
| RU | 2576010 | C2 | 2/2016 |
| TW | 430199 | U | 4/2001 |
| TW | M388245 | U | 9/2010 |
| TW | M430199 | U | 6/2012 |
| TW | M476490 | U | 4/2014 |
| TW | 201519805 | A | 6/2015 |
| TW | M541752 | U | 5/2017 |
| WO | 2007138289 | A1 | 12/2007 |
| WO | 2008140152 | A1 | 11/2008 |
| WO | 2009082098 | A2 | 7/2009 |
| WO | 2011121510 | A2 | 10/2011 |
| WO | 2012026315 | A1 | 3/2012 |
| WO | 2014029935 | A1 | 2/2014 |
| WO | 2014139943 | A1 | 9/2014 |
| WO | 2014163364 | A1 | 10/2014 |
| WO | 2015116246 | A1 | 8/2015 |
| WO | 2015190845 | A1 | 12/2015 |
| WO | 2017086254 | A1 | 5/2017 |
| WO | 2018002914 | A1 | 1/2018 |
| WO | 2018022914 | A1 | 2/2018 |
| WO | 2018119034 | A1 | 6/2018 |
| WO | 2020082056 | A1 | 4/2020 |
| WO | 2020082058 | A1 | 4/2020 |

OTHER PUBLICATIONS

Allure: "Lashify False Lashes Review," Published By Sable Yong, Oct. 10, 2018, 9 Pages, Site Visited Feb. 17, 2021, Retrieved from URL: https://www.allure.com/story/lashify-false-eyelashes-review-photos.

Amazon: "6 Pieces Eyelash Packaging Cirle Box with Mirror, Eyelash Storage Box Empty Lash Case with Lash Holder for Women Girls (Rose Gold)," Maitys, Amazon.com, Jun. 23, 2020, 1996-2021, pp. 1-8, Site visited Oct. 25, 2021, Retrieved from URL: https://www.amazon.co.uk/piece-Eyelash-Packaging-Circle-Storage/dp/B08BNZ5GQQth=1.

Amazon: "Alessi Yoyo Pill Box, Published by Michel Bouquillon," Nov. 20, 2018, 9 Pages, Site Visted Aug. 6, 2020, Retrieved from URL: https://www.amazon.com/Alessi-Stainless-Steel-Michel-Bouquillon/dp/B07KKFQNQ6.

Amazon: "KISS I-ENVY Premium Quattro 01 Lashes," 3 Pages, [Retrieved on Dec. 30, 2020] Retrieved from URL: https://www.amazon.ca/Kiss-ienvy-quattro-Makeup-Count/dp/B016SKJJKM.

Amazon: "KISS I-ENVY Quattro 02 Lashes, Pack of 3," 5 Pages, [Retrieved on Dec. 30, 2020] Retrieved from URL: https://www.amazon.com/iEnvy-Kiss-Quattro-Lashes-Pack/dp/B01706J2FG.

Amazon: "KISS I-ENVY Quattro Lashes 01, Pack of 3," 5 Pages, [Retrieved on Dec. 30, 2020] Retrieved from URL: https://www.amazon.com/iEnvy-Kiss-Quattro-Lashes-Pack/dp/B06XGBTCHW.

Amazon: "KISS I-ENVY Trio Medium Lashes 30 Trio Lashes (2 Pack)," 7 Pages, [Retrieved on Mar. 9, 2021] Retrieved from URL: https://www.amazon.com/Kiss-Envy-Trio-Medium-Lashes/dp/B018JORMXU.

Amazon: "KISS I-ENVY Ultra Black Trio Medium Lashes KPEC02UB (2 Pack)," 7 Pages, [Retrieved on Mar. 9, 2021] Retrieved from URL: https://www.amazon.com/Kiss-Envy-Ultra-Black-Medium/dp/B00W2C4HPS?th=1.

Amazon: "Lashview Vetus Angled Pointed Perfect Craft Fine Angled Removal Stainless Steel Tip Curved Tweezers for Professional Grafting Eyelash Extension False Eyelash Nail Art Electionics Medical," By Lashview Vetus, Found on Amazon on Apr. 15, 2021, 1 Page, Retrieved from URL: https://www.amazon.com/dp/B01M4KQOCH/ref=sspa_dk_detail_0psc=1;pd_rd_i= Mar. 22, 2018.

(56) References Cited

OTHER PUBLICATIONS

Amazon: "Leteveri Eyelash Applicator Tool—35mm Width False Eyelash Tool with Silicone Clip Design, 2PCS Eyelash Tweezers for False Lashes," Oct. 12, 2022, 1 Page, [Retrieved on Mar. 10, 2023] Retrieved from URL: https://www.amazon.com/Leteveri-Eyelash-Applicator-Tool-Silicone/dp/BOBM5QYC1F/ref=sr_1_3?crid=3SMPJ51ZRAT4Nkeywords =.
Amazon: "Ocamo False Eyelashes Curler Stainless Steel Extension Eye Lash Applicator Remover Tweezers Clip Makeup Tools," 3 Pages, [Retrieved on Oct. 10, 2018] Retrieved from URL: https://www.amazon.kin/Ocamo-Eyelashes-Stanless-Extension-Applicator/dp/B07FT5XW8C?ag=googinhydr18418-21tag=googinkenshoo-21&ascsu.
Amazon.com: "Kiss Ever Ez Lahes 30 Count Trio Lashes in Various Lengths 57927: Beauty," 8 Pages, [Retrieved on Mar. 9, 2021] Retrieved from URL: https://www.amazon.com/kiss-Lahes-Lashes-Various-Lengths/dp/B00JH7SR4S.
Ammancart: "KISS I-ENVY Premium Quattro 01 Lashes," 2 Pages, [Retrieved on Dec. 30, 2020] Retrieved from URL: https://www.ammancart.com/products/kiss-i-envy-premium-quattro-01-ashes-kpe62.
Beautylicious: "KISS I-ENVY Pre-Cut Lashes," 4 Pages, [Retrieved on Dec. 30, 2020] Retrieved from URL: https://www.shopbeautylicious.com/products/kiss-i-envy-pre-cut-lashes.
Beautyproducstusa: "KISS I-ENVY Premium Quattro 01 Lashes," 2 Pages, [Retrieved on Dec. 30, 2020] Retrieved from URL: https://www.beautyproductsusa.com/home/322-kiss-i-envy-strip-eyelash-quattro-01-kpe62.html.
Bicoastal Beauti: "KISS i-ENVY Premium Quattro 01 Lashes (KPE62)," 3 Pages, [Retrieved on Dec. 30, 2020] Retrieved from URL: https://www.bicoastalbeauti.com/shop/kiss-brand-lashes/kiss-i-envy-premium-quattro/.
Bilobeauty: "KISS I-ENVY Premium Quattro 01 Lashes," 2 Pages, [Retrieved on Dec. 30, 2020] Retrieved from URL: https://www.biloltd.net/product-p/60351.html.
BL Lashes: "Your Guide to Russian vol. Lash Extensions," 10 Pages, [Retrieved on Mar. 29, 2023] Retrieved from URL: https://www.bllashes.com/blogs/blog/your-guide-to-the-must-have-tools-for-russian-volume-lashes.
Born Pretty: "False Eyelashes Thick Natural Simulation Recyclable Curly False Eyelash Makeup Cosmetic Tools," 6 Pages, [Retrieved on Oct. 18, 2018] Retrieved from URL: http://www.bornprettystore.com/false-eyelashes-thick-natural-simulation-recyclable-curly-false-eyelash-makeup-cosmetic-tools-p-44675.
Brandrup J., et al., "Polymer Data Handbook," 1999, New York: Wiley, Edited by James E. Mark, vol. 89, 7 Pages.
Buykorea: "Plastic, False Eyelash Applicator, Multy colour," Tweed K Inc., pp. 1-3, [Retrieved on Feb. 14, 2019] Retrieved from URL: http://www.buykorea.or.kr/product-details/Plastic-False-Eyelash-Applicator-Multy-colour-3106709.html.
Cardellino C., "You've Been Applying False Eyelashes Wrong Your Whole Life," Cosmopolitan, Mar. 25, 2016, 12 Pages, [Retrieved on Aug. 23, 2019] Retrieved from URL: https://www.cosmopolitan.com/style-)eauty/beauty/how-to/a55781/this-false-eyelash-hack-will-change-your-life/.
Cashmere Cosmetics: "KISS I-ENVY Premium Quattro 01 Lashes," 4 Pages, [Retrieved on Dec. 30, 2020] Retrieved from URL: https://www.cashmerecosmetics.com/product/kiss-i-envy-quattro-01-lashes/.
Delicate Hummingbird: "Ha! I've Mastered the False Lashes!," Nov. 10, 2011, 12 Pages, Retrieved from URL: http://delicatehummingbird.blogspot.com/2011/11/ha-ive-mastered-false-lashes.html.
Ebay: "KISS I-ENVY Strip Eyelashes—Pack of 2 (Choose Your Style)," 2 Pages, [Retrieved on Dec. 30, 2020] Retrieved from URL: https://www.ebay.com.au/itm/Kiss-I-Envy-Strip-Eyelashes-Pack-of-2-Choose-your-Style/1 83303124469.
Ebay: "BL Kiss I Envy Quattro 01 Lashes—Two Pack," 4 Pages, [Retrieved on Dec. 30, 2020] Retrieved from URL: https://www.ebay.ca/itm/BL-Kiss-I-Envy-Quattro-01-Lashes-Two-PACK-/293706028541.
Ebay: "Ienvy," 23 Pages, [Retrieved on Dec. 30, 2020] Retrieved from URL: https://www.ebay.eom/sch/i.html_nkw=Ienvy&norover=1&mkevt=1&mkrid=711-156598-701868-2&mkcid=2&keyword=ienvy&crip=435059434779.
Ebay: "Kiss Ever EZ Trio Lashes Medium Combo 30 EA 2pk," [Retrieved on Mar. 9, 2021] Retrieved from URL: https://www.ebay.com/urw/Kiss-Ever-EZ-Trio-Lashes-Medium-Dombo-30-EA-2pk/product-reviews/1117964400?pgn=2#.
Ebay: "Kiss I-Envy Premium Quattro 01 Lashes," 3 Pages, [Retrieved on Dec. 30, 2020] Retrieved from URL: https://www.ebay.com/p/1044019861.
Ebnesajjad S., et al., "Classification of Adhesives and Compounds," Adhesives technology handbook, Nov. 26, 2014, pp. 67-83.
Electron Microscopy Sciences: "EMS High Precisions and Ultra Fine Tweezers," Feb. 13, 2019, 7 Pages, Retrieved from URL: https://www.emsdiasum.com/microscopy/products/tweezers/ultra_fine.aspx.
Extended European Search Report for European Application No. 17835287.8, dated Feb. 11, 2020, 05 Pages.
Extended European Search Report for European Application No. 17884561.6, dated Sep. 11, 2020, 8 Pages.
Extended European Search Report for European Application No. 21185294.2, dated Oct. 11, 2021, 9 Pages.
Extended European Search Report for European Application No. 22211037.1, dated Mar. 7, 2023, 6 Pages.
Facebook: "Avant Garde Beauty, Eyelash Holder," Aug. 12, 2020, 2 Pages, Eyelash Holder, Site Visited Oct. 5, 2022, Retrieved from URL: https://www.facebook.com/photo/fbid=162270508866790&set=a.161502768943564.
Falscara By: "The New Line of Kiss Lashes," KISS, 2021, 1 Page, Found online on [Apr. 7, 2023] Retrieved From URL: https://www.youtube.com/watch?v=cQfRFdZa1zE&t=2s.
First Office Action for Chinese Application No. 201780004312.1, dated May 7, 2020, 17 Pages.
First Office Action for Chinese Application No. 201780033755.3, dated Aug. 28, 2020, 8 Pages.
Focallure: "Eyelash Tweezer Applicator By ILash," Shopfocallure, Feb. 14, 2019, 1 Page, Retrieved from URL: https://shopfocallure.com/collections/eyelashes/products/eyelash-tweezer-by-focallure.
Glad Girl: "Glad Lash Flare Cluster Lash Application," Jan. 31, 2014, 49 Pages, Retrieved from URL: https://www.youtube.com/watch?v=JU_ZcY95nVo&t=23s.
Hollyren: "DIY Eyelash Extensions Superfine Band Cluster Lashes Kit," 3 Pages, [Retrieved on Feb. 5, 2021] Retrieved from URL: https://www.hollyren.com/DIY-Eyelash-Extensions-Superfine-Band-Cluster-Lashes-Kit_7740.html.
Hollyren: "OEM Eyelash Applicator By: Hollyren," Apr. 7, 2023, 1 Page, Retrieved from URL: https://www.hollyren.com/ProDetail/Oem%20eyelash%20applicator.
Hongiun Web Page: Oct. 31, 2018, 16 Pages, Retrieved from URL:https://detail.1686.com/offer/574685154963.html?spm=a2615.7691456.iewlist.75.22f96dc5Msy00t.
Ienvy: "KISS-IENVY Collection," 02 Pages, [Retrieved on Dec. 30, 2020] Retrieved from URL: ienvybykiss.com.
Imagessentials: "How to Wear False Eyelashes Without Looking Like You're Wearing Them," 2012, 5 Pages, Retrieved from URL: https://imagessentials.wordpress.com/2012/03/30/how-to-wear-false-eyelashes-without-looking-like-youre-wearing-any/.
Influenster: "KISS I-ENVY Eye Lash Adhesive (6g Individual, Clear) Reviews," 4 Pages, [Retrieved on Dec. 30, 2020] Retrieved from URL: https://www.influenster.com/reviews/kiss-i-envy-eye-lash-adhesive-6g-individual-clear.
Instagram: "Lashify Wand," 1 Page, [Retrieved on 2019] Retrieved from URL: https://www.instagram.com/p/BWgeQ8wg00SR/iqshid=zauiyw8a6v5.
International Preliminary Report on Patentability for International Application No. PCT/US2017/044217, dated Feb. 7, 2019, 8 Pages.

(56) References Cited

OTHER PUBLICATIONS

International Preliminary Report on Patentability for International Application No. PCT/US2017/067513, dated Jul. 4, 2019, 9 Pages.
International Search Report and Written Opinion for International Application No. PCT/US2017/044217, dated Nov. 27, 2017, 15 Pages.
International Search Report and Written Opinion for International Application No. PCT/US2017/067513, dated Mar. 12, 2018, 10 Pages.
International Search Report and Written Opinion for International Application No. PCT/US2019/057102, dated Dec. 23, 2019, 12 Pages.
International Search Report and Written Opinion for International Application No. PCT/US2019/057104, dated Dec. 19, 2019, 8 Pages.
International Search Report and Written Opinion for International Application No. PCT/US2020/013561, dated May 7, 2020, 10 Pages.
International Search Report and Written Opinion for International Application No. PCT/US2020/054014, dated Jan. 20, 2021, 11 Pages.
Japonesque False Eyelash Applicator, 1 Page.
Japonesque: "False Lash Applicator," Feb. 13, 2019, 6 Pages, Retrieved from URL: https://japonesque.com/products/implements/false-lash-applicator/.
Kiss Nail Products Inc: Third Supplemental Objections and Responses to Lashify, Inc.'s First Set of Interrogatories (Nos. 1-56) Investigation No. 337-TA-1226, "In the Matter of Certain Artificial Eyelash Extension Systems, Products, and Components Thereof," Mar. 10, 2021, 430 Pages.
Kissusa: "A True Lash Extension Look in Minutes Falscara the New Way to Lash," Feb. 5, 2021, 6 Pages, Retrieved from URL: https://www.kissusa.com/falscara-false-ayelash-extension-look.
Kissusa: "DIY Lash Extensions By: KISS," May 20, 2021, 1 Page, [Retrieved on Apr. 7, 2023] Retrieved from URL: https://www.kissusa.com/kiss-falscara-eyelash-starter-kit-01.
Kissusa: "Falscara Starter Kit," Dec. 15, 2021, 1 Page, [Retrieved on Apr. 7, 2023] Retrieved from URL: https://www.kissusa.com/lashes/kiss-falscara-eyelash-starter-kit-01.
Kissusa: "Falsecara Eyelash By: KISS," Sep. 20, 2020, 5 Pages, [Retrieved on Apr. 17, 2021] Retrieved from URL: https://web.archive.org/web/20201126033616/https://www.kissusa.com/lashes/kiss-falscara-eyelash-starter-kit-01.
Kissusa: "KISS Falscara Eyelash-Bond & Seal," 3 Pages, Retrieved from URL: https://www.kissusa.com/kiss-falscara-eyelash-bond-seal.
Lades: "Eyelashes Clip—2 Pieces False Eyelashes Applicator Tool Eyelash Extension Tweezers Remover Clip Nipper," Amazon, Aug. 2, 2017, 22 Pages, XP055720051, Retrieved from URL: https://www.amazon.co.uk/Eyelashes-Clip-Applicator-Extension-Tweezers/dp/B07PK6VBVW.
Lashaddict: "KISS I-Envy by Kiss Premium Quattro 02 Lashes," 4 Pages, [Retrieved on Dec. 30, 2020] Retrieved from URL: https://www.lashaddict.nl/kiss-i-envy-lashes-quattro-02.html.
Lashify: "Lashify Gossamer Lash Cartridge," Jun. 15, 2018, 2 Pages, Retrieved from URL: https://lashify.com/collections/shop-1/products/gossamer-eye-lozenge-c-style/variant=783670738950.
LashifY: "Violet Gossamer," Sep. 30, 2020, 7 Pages, Site Visited Feb. 17, 2021, Retrieved from URL: https://lashify.com/products/gossamer-lash-cartridge-prismatic-colors-violetvariant=20045369835631.
Lindstrom I., et al., "Occupational Asthma and Rhinitis Caused by Cyanoacrylate-based Eyelash Extension Glues," Occupational Medicine, Apr. 3, 2013, vol. 63, No. 4, pp. 294-297.
Loveyelashes: "KISS I-ENVY Premium Quattro 01 Lashes," 2 Pages, [Retrieved on Dec. 30, 2020] Retrieved from URL: https://www.loveyelashes.com/bfont-colorgreenstrip-lashesfontb-299-envy-by-kiss-quattro-01-(1555,129,1,48)p.html#.
Mac Cosmetics: "34 Lash," Feb. 14, 2019, 1 Page, Retrieved from URL: http://www.bornprettystore.com/false-eyelashes-thick-natural-simulation-recyclable-curly-false-eyelash-makeup-cosmetic-tools-p-44675.html.
Madame Madeline: "Ardell Dual Lash Applicator (62059)," 3 Pages, [Retrieved on Oct. 18, 2018] Retrieved from URL: https://www.madamemadeline.com/online_shoppe/proddetail.asp?prod=mm62059.
Madame Madeline: "KISS I-ENVY Premium Quattro 01 Lashes (KPE62)," 2 Pages, [Retrieved on Dec. 30, 2020] Retrieved from URL: https://www.madamemadeline.com/online_shoppe/proddetail.asp?prod=mmKPE62.
Made in China: "New Product Eyelashes Aid Eyelashes Applicator Innovative Eyelashes Curler," 2018, 2 Pages, [Retrieved on Feb. 13, 2019], Retrieved from URL: https://www.made-in-china.com/productdirectory.do?word=creative+eyelashe-curler&subaction=hunt&style=b&mode=and&code=0&comProvince=nolimit&order=0&isOpenCoiTection=1.
Matweb: "Overview Of Materials For Polybutylene Terephthalate (PBT), Unreinforced, Molded," [Retrieved on Mar. 29, 2023] 5 Pages, Retrieved from [URL: https://www.matweb.com/search/datasheet_print.aspx?matguid=781bd0e9d0854fd5a919866c39ea3065].
Modernbeauty: "KISS I-ENVY Individual Eye Lash Adhesive," 3 Pages, [Retrieved on Dec. 30, 2020] Retrieved from URL: https://www.modernbeauty.com/cosmetics/lashes/false-lashes/Product/26961-i-envy-individual-eyelash-adhesive-retail.html.
Notter E., "The Art of the Chocolatier from Classic Confections to Sensational Showpieces," John Wiley Sons, Jan. 18, 2011, 4 Pages.
Office action for Japanese Application No. 2019504850, dated Aug. 30, 2021, 8 Pages.
Pak Lajpall: "Nail Artist Tweezers PL-1," 1 Page, [Retrieved on Feb. 13, 2019], Retrieved from URL: http://www.laipall.com/proddetail.prod=nail-artists-tweezers1.
Palin G.R., "Plastics for Engineers: An Introductory Course," Chapter 13, Thermosetting Plastics, Elsevier, 1967, pp. 125-139.
Patent Trial and Appeal Board (PTAB), PGR2021-00045, *Kiss Nail Products Incorporated* (Petitioner) v. *Lashify Incorporated* (Patent Owner).
Patent Trial and Appeal Board (PTAB), PGR2021-00046, *Kiss Nail Product Incorporated* v. *Lashify Incorporated* (Patent Owner).
Peonies and Lilies: "Bourjois 2 in 1 Tweezers and Faux & Fabulous Eyelashes," Beauty, Lifestyle, Travel, Oct. 24, 2012, 2 Pages.
Picclick: "I-Envy By Kiss So WISPY #01 Strip Eyelashes KPE58 False Lashes Black 1 Pair New," Dec. 30, 2020, 8 Pages, Retrieved from URL: https://www.picclickimg.com/d/w1600/pict/292311410878_/i-ENVY-by-Kiss-SO-WISPY-01-Strip-Eyelashes.jpg.
Pinterest: "How to Apply iENVY Quattro Collection Eyelashes," Dec. 30, 2020, 14 Pages, [Retrieved on Mar. 31, 2023] Retrieved from URL: https://www.pinterest.com/pin/433472151413160 80/.
Pinterest: "Kiss Bring the Salon Home," 2 Pages, [Retrieved on Dec. 30, 2020] Retrieved from URL: https://www.pinterest.com.au/pin/19562579608263895/.
Pinterest: "KISS I-ENVY 100% Human Eyelash So Wispy 03," 3 Pages, [Retrieved on Dec. 30, 2020] Retrieved from URL: ; https://www.pinterest.co.kr/pin/308285536984155041/.
Pinterest: "KISS I-Envy by Kiss 100% Human Pre Cut Eyelash Quattro 02 Lashes," 2 Pages, [Retrieved on Dec. 30, 2020] Retrieved from URL: https://www.pinterest.cl/pin/576038608568497288/amp_client_id=CLIENT_ID(_J&mweb_unauth_id=&from_amp_pin_page=true.
Pinterest: "Kiss Premium Lashes, I-ENVY by KISS Premium Lashes," 2 Pages, [Retrieved on Dec. 30, 2020] Retrieved from URL: https://www.pinterest.es/amp/pin/449515606533816815/.
Qingdao Hongfutian Eyelash Co., Ltd., Youtube, Oct. 13, 2016, 21 Pages, Retrieved from URL: https://www.youtube.com/watch?v=rinKgJJm7-0.
Rich., "Buzludzha Monument, Gueorguy Stoilov Circa," Justanotherbackpacker.com, Apr. 29, 2014, 10 Pages, Site Visited on Aug. 27, 2019, Retrieved from URL: http://www.justanotherbackpacker.com/buzludzha-monument-bulgaria-ufo/.

(56) References Cited

OTHER PUBLICATIONS

Rodulfo K., "This DIY Lash Extension Kit Has Ruined Mascara for Me Forever," ELLE, May 16, 2018, 6 Pages, [Retrieved on Dec. 31, 2018] Retrieved from URL: https://www.elle.com/beauty/makeup-skin-care/a20704236/lashify-lashes-kit-review/.
Rosato M.G., et al., "Basics and Overviews of Plastics Fabricating Processes," Springer Science Business Media, New York, 2000, pp. 39-52.
Satkowski M.M., "The Crystallization and Morphology of Polyethylene and its Blends," Doctoral Dissertations 1896—Feb. 2014, Jan. 1, 1990, 4 Pages.
Search Report and Written Opinion for Singapore Application No. 10202106633V, dated Jan. 21, 2022, 13 Pages.
Siegmann A., et al., "Melting and Crystallization of Poly (Ethylene Terephthalate) under Pressure," Journal of Polymer Science: Polymer Physics Edition, 1980, vol. 18 (11), pp. 2181-2196.
Silmy's Eyelashes, Youtube, 2011, 11 Pages, Retrieved from URL: https://www.youtube.com/watch?v=I_rg1ybHUwY.
Staar Alert: "Locking Automated Medication Dispenser," Starralert.com, WayBack Machine, Staar Altelt, Aug. 14, 2020, 4 Pages, [Retrieved online on Feb. 19, 2021] Retrieved from URL: https://www.staaralert.com/locking-medication-dispenser.
"The Small Things, How to Fake a Thicker Lash Line, "May 17, 2017, Retrieved from URL: https://www.thesmallthingsblog.com/2016/05/how-to-Fake-a-thicker-lash-lme/#:text=Pick%20up%20a%20gel%20orof%20a%20thicker%20lash%20lme.
The Sunday Girl: "Bourjois-2-in-1 Tweezers and False Eyelash Applicator Review," Nov. 5, 2012, 1 Page, [Retrieved on Apr. 13, 2021] Retrieved from URL: http://www.thesundaygirl.com/2012/11/bourjois-2-in-1-tweezers-and-false.html.
Troughton M.J., et al., "Handbook of Plastics Joining: A Practical Guide," 2nd Edition, William Andrew Incorporated, Oct. 17, 2008, 25 Pages.
Tweezers: "Eyelash Tweezers—FEITA Precision Eyelash Extension Tweezers Set-Professional Straight & Curved Pointed Very Fine Tip Tweezers for Lash Extensions—Black-2Pcs," Reviewed on Dec. 13, 2016 on Amazon.com, 30 Pages, [Retrieved on Dec. 31, 2018] Retrieved from URL: https://www.amazon.com/Eyelash-Tweezers-Precision-Extension-Professional/dp/B01I2KSUDSth=1.
Ubuy: "I-Envy by Kiss Premium Quattro 02 Lashes," Dec. 30, 2020, 3 Pages, Retrieved from URL: https://www.ubuy.com.kw/en-sa/catalog/product/view/id/37236.
United Beauty Supply: "KISS I-ENVY Trio Lashes Ultra vol. KPEC—3X Volume," 7 Pages, [Retrieved on Mar. 9, 2021] Retrieved from URL: https://www.unitedbeautysupply.com/product/kiss-i-envy-trio-lashes-ultra- /olume-kpec/.
United States District Court District of California San Francisco Division, 3:20-cv-06086, *Lashify Incorporated* v. *Alicia Zeng and Patrick Ellsworth d/b/a Lilac St; and Artemis Family Beginnings Incorporated*.
United States District Court District of New Jersey, 2:20-cv-10023-JMV-MF, *Lashify Incorporated* v. *Kiss Nail Products Incorporated*.
U.S.Salonsupply: "KISS I-ENVY Premium Quattro 01 Lashes," 2 Pages, [Retrieved on Dec. 30, 2020] Retrieved from URL: https://www.ussalonsupply.com/Kiss-I-Envy-Quattro-01-Lashes-p_120305.html.
Varga J., et al., "Vibration Welding of Alpha and Beta Isotactic Polypropylenes: Mechanical Properties and structure," Express Polymer Letters, Mar. 1, 2008, vol. 2, No. 3, pp. 5-19.
Versionone S., "Cruiser Portable Speaker," NYNE, Published at thegamerwithkids.com, Posted on Apr. 6, 2015, not listed, [Cite Visited Jun. 20, 2018],3 Pages, Retrieved from URL: https://thegamerwithkids.com/2015/04/06/nyne-cruiser-review-a-wireless-speaker-for-your-bycicle/.
Walmart: "KISS I-Envy by Kiss Premium Quattro 02 Lashes," 8 Pages, [Retrieved on Dec/ 30, 2020] Retrieved from URL: https://www.walmart.com/ip/Kiss-I-Envy-Quattro-02- Lashes/187353459.
"Why Tightlining is the Makeup Trick you Need to Try," Get The Gloss, May 6, 2016, 6 Pages, Retrieved from URL: https://www.getthegloss.com/beauty/makeup/why-tightlining-is-the-makeup-trick-you-need-to-try.
Youtube: "How To Apply False Lashes UNDER Your Lashes Reverse Eyelash Trick Makeup Hack," 2016, 40 Pages, Retrieved from URL: https://www.youtube.com/watch?v=BCq4xCQrQHE.
Youtube: "How To Apply Individual Lashes ft. Ardell Individuals | Melissa Alatorre," 2015, 46 Pages, Retrieved from URL: https://www.youtube.com/watchv=c2iqLwjryWM.
Youtube: "All About Eyelash Extensions! FAQ's Application FAQ'S SaturdayNightsAlrite," 2013, 175 Pages, Retrieved from URL: https://www.youtube.com/watch?v=MTL70W58I9I.
Youtube: "Applying False Lashes Underneath Your Own Top Eye Lashes Best Beauty Tip/Hack Ever," Jul. 2, 2016, 46 Pages, Retrieved from URL: https://www.youtube.com/watch2v-FzEtZgY-5Y8.
Youtube: "Applying Falsies Under Lash ?! Does It Work?," Sep. 14, 2016, 57 Pages, Retrieved from URL: https://www.youtube.com/watch?v=V96EKKAe03c.
Youtube: "Applying Falsies Under Lash Does It Work !! ," Sep. 27, 2016, 57 Pages, Retrieved from URL: https://www.youtube.com/watch?v=5kytWJOQbg.
Youtube: "Applying Falsies Underneath Lash," Sep. 24, 2016, 47 Pages, Retrieved from URL: https://www.youtube.com/watch?v=6VopJnVWv8s&t=13s.
Youtube: "Applying Falsies Underneath Reverse Best Lash Hack," Sep. 22, 2016, 20 Pages, Retrieved from URL: https://www.youtube.com/watch?v=GhG5hoMh000.
Youtube: "Artificial Eyelashes (1949)," Apr. 13, 2014, 87 Pages, Retrieved from URL: https://www.youtube.com/watch?v=8Fv7EzDvo58.
Youtube: "Crazy False Eyelash Hack For Natural Comfortable Lashes," 2017, 31 Pages, Retrieved from URL: https://www.youtube.com/watch?v=99rHNYe3GFw.
Youtube: "DEYEKO—Olga Lydia Factory Visit," Jun. 24, 2013, 47 Pages, Retrieved from URL: https://www.youtube.com/watch?v=Q5ZLklqkEtY.
Youtube: "Dream Lashes Curved Volme Tweezer—3 Minute Test," Sep. 30, 2016, 1.15-1.30, 1 Page [Downloaded on Feb. 13, 2019] Retrieved from URL: https://www.youtube.com/watch?v:vwqYeE0SD7s.
Youtube: "False Lashes Tips And Tricks For Beginners, The How to Guide for Lashes," Jan. 27, 2017, 36 Pages, Retrieved from URL: https://www.youtubecom/watchv=BaQO8g4iUxY.
Youtube: "FalseLashes, Falscara By: KISS," Dec. 23, 2019, 1 Page, [Retrieved on Apr. 4, 20234] Retrieved from URL: https://www.youtube.com/watch?v=cQfRFdZa1zE.
Youtube: "Goodyard Eyelash Production Process," Goodyardhair Factory, 2016, 57 Pages, Retrieved from URL: https://www.youtube.com/watch?v=FIxGtTPNALo.
Youtube: "How False Eyelashes Are Made," Nov. 29, 2015, 69 Pages, Retrieved from URL: https://www.youtube.com/watch/=hqsxokthwqg.
Youtube: "How to Apply Cluster Party Lashes 2," Feb. 12, 2014, 43 Pages, Retrieved from URL: https://www.youtube.com/watch?v=faKvACCAvNU.
Youtube: "How To Apply False Eyelashes For Beginners Two Easy Ways," Sep. 6, 2013, 29 Pages, Retrieved from URL: https://www.youtube.com/watch?app=desktop&v=790S17fNzOE.
Youtube: "How To Apply False Lashes . . . Underneath !? ," Jan. 13, 2017, 66 Pages, Retrieved from URL: https://www.youtube.com/watch?v=mlkvFgb8PmA.
Youtube: "How to Apply iENVY Quattro Collection Eyelashes," Aug. 18, 2015, 14 Pages, Retrieved from URL: https://www.youtube.com/watch?v=kW-ovlGoCmc.
Youtube: "How To Apply Individual False Lashes—Lashes Love Leather," 2016, 24 Pages, Retrieved from URL: https://www.youtube.com/watch?v=nLMz-lauMkl.
Youtube: "How to Apply Individual Lashes," Apr. 5, 2010, 77 Pages, Retrieved from URL: https://www.youtube.com/watch?v=9X84CUIWqgo.

(56) References Cited

OTHER PUBLICATIONS

YOutube: "How to Apply Individual Lashes," Mar. 16, 2013, 77 Pages, Retrieved from URL: https://www.youtube.com/watch?v=aLHE2SqzIO8.
Youtube: "How to Apply Lashes Using Sephora Bull Eye Lash Applicator," Nov. 14, 2012, 32 Pages, Retrieved from URL: https://www.youtube.com/watch?v=yYwcYzXJX4M.
Youtube: "How To Fake Eyelash Extensions Reviewing Kiss Ever EZ Lashes," 2015, 40 Pages, Retrieved from URL: https://www.youtube.com/watch?v=AhJyTcClaMs.
Youtube: "How To Master Individual Fake Eyelashes NewBeauty Tips & Tutorials," Aug. 21, 2015, 56 Pages, Retrieved from URL: https://www.youtube.com/watch?v=ObltZN1NsB0&t=44s.
Youtube: "IN DEPTH Tutorial Ardell Lashtite Glue Apply Under My Natural Lashes," Feb. 24, 2015, 40 Pages, Retrieved from URL: https://www.youtube.com/watch?v=comq0clt56o.
Youtube: "Introducing Kiss EverEZ Trio Lashes," May 10, 2013, 47 Pages, Retrieved from URL: https://www.youtube.com/watch?v=37z4VMQ7Yxc.
Youtube: "Lisa Eldridge—How To Apply Individual False Eyelashes Tutorial," Youtube, Mar. 17, 2010, 45 Pages, Retrieved from URL: https://www.youtube.com/watch?v=IKO10VdtLFU.
Youtube: "Solving the Oval Office Puzzle Box," Puzzle Master Incorporated, Published by PuzzleOZ, Jun. 4, 2017, 7 Pages, Site Vistied May 17, 2019, Retrieved from URL: https://www.youtube.com/watchv=wzZCm9sUU7E.
Youtube: "Process of Making False Eyelash Product," Lux Beauty Lashes, Dec. 12, 2015, 53 Pages, Retrieved from URL: https://www.youtube.com/ watchv=515QCxnjrkQ.
Youtube: "Process of Making Mellow Eyelashes," Youtube, [Retrieved on Nov. 13, 2015] Retrieved from URL: https://www.youtube.com/watch7v~/IhGQX58HM&t=2s.
Youtube: "Reverse Eyelash Hack: Does it work?," Oct. 12, 2016, 75 Pages, Retrieved from URL: https://www.youtube.com/watch?v=sx_X89xdBbE.
Youtube: "Reverse Eyelash Trick Makeup Hack," Sep. 18, 2016, 55 Pages, Retrieved from URL: https://www.youtube.com/watch?/=FQFF1sOQbCI.
Youtube: "Reverse Eyelash Tutorial-Irisbeilin," Sep. 13, 2016, 20 Pages, Retrieved from URL: https://www.youtube.com/watch/=q1Cu0p6bqHs.
Youtube: "Review New Kiss | Envy EZ Lashes Trio Lashes—Easier Than Individual Lashes," Mar. 10, 2021, 47 Pages, Retrieved from URL: https:// www.youtube.com/watch?v=BS9G6jgDgOA.
Youtube: "The Best Way to Apply False Lashes," Cosmopolitan, Apr. 1, 2016, Retrieved from URL: https://www.youtube.com/watch?/=40yZu-4KZs8.
Youtube: "The Process of Making Regular Eyelash Products," Nov. 2, 2015, Retrieved from URL: https://www.youtube.com/watch?v=mVATdu3dw5c.
Youtube: "Trio Lashes Are So In Right Now | Ever EZ Lashes By KISS," Feb. 20, 2015, 43 Pages, Retrieved from URL: https://www.youtube.com/watch?v=bx6PXgZMvhg.
Eyelash applicator tool By Leteveri found on Amazon (Dec. 14, 2023)https://www.amazon.com/Leteveri-Eyelash-Applicator-Tool-Silicone/dp/BOBM5QYC1 F/ref=sr_1_3crid=3SMPJ51ZRAT4N keywords= (Oct. 12, 2022).
International Search Report and Written Opinion for International Application No. PCT/US2022/039083, mailed Oct. 31, 2022, 16 Pages.
International Search Report and Written Opinion for International Application No. PCT/US2022/045558, mailed Dec. 20, 2022, 15 Pages.
Lash Applicator By: Pro Lashbeauty (Dec. 14, 2023)https://www.amazon.com/dp/B0CB3ZZRTJ/ref=sspa_dk_detail_0psc=1pd_rd_i=B0CB3ZZRTJpd_rd_w=v4LsUcontent-id= amzn1.sym.68f30e61-3dba-4ebe-8f1b-a0b000b95ff8pf_rd_p= (May 3, 2023).
Shopee: "Tweezer Applicator for False Fake Eyelash Eye Lash Lashes Falsies Cosmetic Tool," Jul. 14, 2019, 1 Page, [Retrieved on Oct. 14, 2022] Retrieved from URL: https://shopee.ph/Tweezer-Applicator-For-False-Fake-Eyelash-Eye-Lash-Lashes-Falsies-Cosmetic-Tool-i.63392971.1750684108.
Shopee: "Vetus Tweezers, Anti Static Non-Magnetic, High Precision Stainless Steel Tweezer Tool," Aug. 10, 2021, 1 Page, [Retrieved on Oct. 14, 2022] Retrieved from URL: https://shopee.com.my/VETUS-Tweezers-Anti-Static-Non-Magnetic-High-Precision-Stainless-Steel-Tweezer-Tool-i. 183308257.783935374.
Amazon: "Eyelash Applicator Tool By: Lasnten," Mar. 2, 2022, 1 Page, [Retrieved on Nov. 14, 2023] Retrieved from [https://www.amazon.com/Lasnten-Applicator-Tweezers-Extensions-Stainless/dp/B0CG9DDLTN?th=1].
Extended European Search Report for European Application No. 19873364.4, mailed Jun. 15, 2022, 10 Pages.
Extended European Search Report for European Application No. 19874123.3, mailed Jun. 21, 2022, 8 Pages.
Extended European Search Report for European Application No. 20741513.4, mailed Oct. 21, 2022, 9 Pages.
Extended European Search Report for European Application No. 20741939.1, mailed Sep. 9, 2022, 8 Pages.
False Eyelashes: "False Eyelashes 101 Tip: How (and Why) to Layer False Eyelashes," May 2, 2012, 11 Pages, Retrieved from URL: https://elegantlashesblog.wordpress.com/2012/05/02/false-eyelashes-101-tip-how-and-why-to-layer-false-eyelashes/.
International Preliminary Report on Patentability for International Application No. PCT/US2019/057102, mailed Apr. 29, 2021, 8 Pages.
International Preliminary Report on Patentability for International Application No. PCT/US2019/057104, mailed Apr. 29, 2021, 8 Pages.
International Preliminary Report on Patentability for International Application No. PCT/US2020/013554, mailed Jul. 29, 2021, 7 Pages.
International Preliminary Report on Patentability for International Application No. PCT/US2020/013561, mailed Jul. 29, 2021, 9 Pages.
International Preliminary Report on Patentability for International Application No. PCT/US2020/054014, mailed Apr. 14, 2022, 8 Pages.
International Search Report and Written Opinion for International Application No. PCT/US2020/013554, mailed May 7, 2020, 8 Pages.
Lashify:"Fuse Control Wand V2, Lashify," Reviewed on Oct. 23, 2018 on Lashify.com, 1 Page, [Retrieved on Dec. 31, 2018] Retrieved from URL: https://lashify.com/collections/lashify-tools/products/fuse-control-wand-v2variant=13400696586351#shopify-product-reviewsretrieved.
MAC: "MAC Lash Applicator," 2014, 4 Pages, Retrieved From URL: https://www.maccosmetics.com/product/13811/32724/products/brushes-tools/tools/sponges-applicators/lash-applicator?gclid=EAlalQobChMlsqzhnlz79AIVHAalCROqngPWEAQYAyABEgKxP_D_BwEgclsrc=aw.ds.
Office Action for Australian Patent Application No. AU20190360273, mailed Nov. 13, 2023, 3 Pages.
Office Action for Australian Patent Application No. AU20220235619, mailed Nov. 14, 2023, 2 Pages.
Office Action for Chinese Patent Application No. 202110550925.3, mailed Oct. 31, 2023, 24 Pages.
Office Action for European Patent Application No. 20190873364, mailed Sep. 19, 2023, 7 Pages.
YouTube: "Falsecara By: KISS," Jan. 2, 2021, 1 Page, [Retrieved on Nov. 14, 2023] Retrieved from [URL:https://www.kissusa.com/products/falscara-starter-kit-diy-lash-extensions].
YouTube [online] [video], Sep. 17, 2014, https://www.youtube.com/watch?v=gfoGzBwvcnE.
Office Action for Canadian Patent Application No. CA3123630 mailed on Jan. 19, 2024, 7 Pages.
Office Action for Indonesian Patent Application IDP00202205125 mailed Jan. 24, 2024, 3 pages.
Office Action for Japanese Patent Application No. JP2023-014624, mailed Dec. 18, 2023, 7 Pages.
Office Action for Canadian Patent Application No. 3123631, mailed Feb. 21, 2024, 06 Pages.

(56) References Cited

OTHER PUBLICATIONS

Office Action for Chinese Patent Application No. 202080069380.8, mailed Mar. 2, 2024, 15 Pages.
Office Action for Japanese Patent Application No. 2022121728, mailed Feb. 8, 2024, 02 Pages.
Office Action for Japanese Patent Application No. 2022520667, mailed Dec. 7, 2023, 02 Pages.
Office Action for Japanese Patent Application No. 2023112532, mailed Feb. 26, 2024, 01 Page.
Office Action for Singapore Application No. 10202106633V, mailed Feb. 27, 2024, 06 Pages.
Canadian Patent Application No. 3206108, Office Action dated Apr. 17, 2024.
Office Action for Chinese Patent Application No. 202080069380.8, mailed May 8, 2024, 17 Pages.
Office Action for European Patent Application No. 20190873364, mailed Mar. 22, 2024, 09 Pages.
Office Action for Korean Patent Application No. 10-2021-7043383, mailed Feb. 26, 2024, 06 Pages.
Office Action for Japanese Patent Application No. 2023109314, mailed Jul. 4, 2024, 06 pages.
YouTube: "Complete Master of Self Eyelash Extensions," YouTube [online] [video], Sep. 17, 2014, 03 Pages, [Retrieved on Mar. 26, 2021], Retrieved from [https://www.youtube.com/watch?v=gfoGzBwvcnE].
Office Action for European Patent Application No. 17884561.6, mailed Mar. 5, 2024, 06 Pages.
Web: "Best Tweezers—Ergonomic Products," The Wayback Machine, Feb. 14, 2014, 02 pages, [Downloaded on Mar. 28, 2024] Retrieved from [URL: https://web.archive.org/web/20120214160346/ http://www.beauty2makeup.com:80/blog/best-tweezers/].
Web: "Diamond Elite Tweezer—Main," Embellashes, Feb. 20, 2024, 03 pages, [Downloaded on Mar. 28, 2024] Retrieved from [URL: https://embellashes.com/product/diamond-elite-tweezer-2/].
Web: "Eyelash Extensions Tweezer," Shine Beauty Group, Feb. 20, 2024, 06 pages, [Downloaded on Mar. 28, 2024] Retrieved from [URL: https://www.shinebeautygroup.com/eyelash-extension-products/p/diamond-elite-tweezers-1].
Web: "ProComfort Ceramic Angled Lash Extensions Tweezer," Xtreme Lashes, Feb. 20, 2024, 03 pages, [Downloaded on Mar. 28, 2024] Retrieved from [URL: https://www.xtremelashes.com/tweezers-and-tools/procomfort-ceramic-angled-tweezer?selection=gad_source=1gclid=EAlalQobChMI34KCotq4hA . . . ].
YouTube: "Bella Lash Diamond Elite Tweezers," Jul. 11, 2016, 36 pages, [Downloaded on Mar. 28, 2024] Retrieved from [URL: https://www.youtube.com/watch?v=yWB4YR6CKYc].
YouTube: "How to : Master Applying False Eyelashes," Jan. 23, 2014, 137 pages, [Downloaded on Mar. 28, 2024] Retrieved from [URL: https://www.youtube.com/watch?v=rtX7pZgiJe8].
YouTube: "How to apply Cluster/Party Lashes 2," Feb. 12, 2014, 79 pages, [Downloaded on Mar. 28, 2024] Retrieved from [URL: https://www.youtube.com/watch?v=faKvACCAvNU].
YouTube: "Introducing: ProComfort Ceramic Angled Tweezer," Aug. 29, 2014, 13 pages, [Downloaded on Mar. 28, 2024] Retrieved from [URL: https://www.youtube.com/watch?v=0AHGR_Y8mvk].
YouTube: "Process of Making Mellow Eyelashes," Nov. 12, 2015, 60 pages, [Downloaded on Mar. 28, 2024] Retrieved from [URL: https://www.youtube.com/watch?v =-VIhGQX58HM].
Eyelash Applicator Tool By: Lasnten found on Amazon (Jul. 10, 2024)https://www.amazon.com/Lasnten-Applicator-Tweezers-Extensions-Stainless/dp/B0CG9DDLTN?th=1 (Mar. 2, 2022).
False Lashes, Falscara By: Kiss found on YouTube (Jul. 10, 2024) https://www.youtube.com/watch?v=cQfRFdZa1zE (Dec. 23, 2019).
Falsecara Eyelash By: Kiss found on YouTube (Jul. 10, 2024)https://www.kissusa.com/products/falscara-starter-kit-diy-lash-extensions (Jan. 2, 2021).
Office Action for Korean Patent Application No. 10-2020-7012359, mailed Jun. 10, 2024, 13 Pages.
Adhesive: "Japonesque Sectional 4 Eyelashes," Sep. 26, 2024, 3 Pages, Retrieved from [https://www.amazon.com/JAPONESQUE-ZM-410-Sectional-4- Eyelashes/dp/B0038R1WOU/ref=cmcr_arp_d_pl_foot_top? ie=UTF8].
Alibaba: "False Eye Lashes 20D Individual Lashes Grafted Eyeslashes Extension," Oct. 2, 2024, 16 Pages, Retrieved from [https://www.alibaba.com/product-detail/false-eye-lashes-20D-individual-lashes_60689734967.html].
Amazon: "Ardell Knot-Free Individual Lash Double, Black, Medium," Retrieved on Oct. 3, 2024, 9 Pages, Retrieved from [https://www.amazon.com/Ardell-Double-Individuals-Flares-Black/dp/B00CA0FL66/ref=cm_cr_arp_d_product_top?ie=UTF8th=1].
Amazon: "Kiss | Envy Knot Free Medium 70 Lashes Ultra Black," [Retrieved on Oct. 3, 2024], 6 Pages, Retrieved from [https://www.amazon.com/Kiss-Medium-Lashes-Ultra-Black/dp/B017O6IMOM?th=1].
Amazon: "Kiss Looks So Natural Lashes Shy (2 Packs)," Beauty Personal Care, 05 Pages, [Retrieved on Oct. 4, 2024], Retrieved from [https://www.amazon.com/Kiss-Looks-Natural-Lashes-Pack/dp/B01AX2Z6NK].
Ardell: "Cluster Wispies 600," The Wayback Machine, Jun. 12, 2016, 03 Pages, Retrieved from [https://web.archive.org/web/20160612220611/http:/ardelllashes.com/Lashes/product_246.html].
Ardell: "Cluster Wispies 603," The Wayback Machine, May 19, 2016, 03 Pages, Retrieved from [https://web.archive.org/web/20160519162211/ http:/www.ardelllashes.com:80/Lashes/product_247.html].
Ardell: "Short Black," Aug. 1, 2016, 3 Pages, Retrieved from [https://web.archive.org/web/20160801162839/http:/www.ardelllashes.com/Lashes/product_89.html].
Ardell: "Individual Lashes," ProTip, Retrieved from [https://www.youtube.com/watch?v=6Peg8U65cK4].
Ardell: "Individual Lashes Started Kit," Jul. 6, 2016, 3 Pages, Retrieved from [https://web.archive.org/web/20160706223201/http:/www.ardelllashes.com:80/Lashes/product_200.html].
Ardell: "Lash Lites," The Wayback Machine, Jul. 15, 2016, 02 Pages, Retrieved from [https://web.archive.org/web/20160715175102/http://www.ardelllashes.com/Lashes/filter_41.html].
Ardell: "Lashes—Demi Wispies," Jun. 29, 2016, 1 page, Retrieved from https://web.archive.org/web/20160629220043/http:/www.ardelllashes.com/Lashes/product_237.html.
"Ardell: Lashes Index," Jul. 15, 2016, Retrieved from [https://web.archive.org/web/20160715175029/http:/www.ardelllashes.com/Lashes/index.html].
Ardell: "Lashes-Lash Trios," Jul. 15, 2016, 1 Page, Retrieved from [https://web.archive.org/web/20160715175032/http://www.ardelllashes.com/Lashes/product_238.html].
Ardell: "Lashes-Long Black" Jul. 8, 2016, 1 Page, Retrieved from [https://web.archive.org/web/20160715175032/http://www.ardelllashes.com/Lashes/prod uct_238.html].
Ardell: "Long Black," Jul. 8, 2016, 3 Pages, Retrieved from [https://web.archive.org/web/20160708102833/ http:/www.ardelllashes.com/Lashes/product_93.html].
Ardell: "Try on Lashes," The Wayback Machine, Jul. 15, 2016, 04 Pages, Retrieved from [https://web.archive.org/web/20160715175036/http:/www.ardelllashes.com/Lashes/filter_108.html].
Beaute4U: "Stars Colors Eyelashes Soft Grafting Eyelash Extension Thick Style 20 Hairs Rabbit anti-Lashes XEB-009," Ideal Beaumax Marketing, Sep. 26, 2024, Retrieved from [https://beaute4u.com/index.php?id_product=56&controller=product].
Camie-Cameron: "How to Apply Individual Lashes Underneath the Eyelid," Camie Cameron Video, Jun. 27, 2016, 31 Pages, Retrieved from [https://www.youtube.com/watch?v=CabxTEY9qjc].
Edmarys: "Eyelash Hack | Reverse Lash Tutorial," Edmarys Video, Jan. 27, 2017, 22 Pages, Retrieved from [https://www.youtube.com/watch?v=NprJRiAQAi8].
"Fing'rs Lash Pocket," Oct. 1, 2024, 3 Pages, Retrieved from [https://www.amazon.de/-/en/Fing%60rs-Lashes-%20pocket/dp/B00ANLZTJS/ref=sr_1_1?qid=1686689361&refinements=p_89%3AFing%60rs&s=beauty&sr=1-1].
Glad Girl: "Glad Lash Signature 5D—vol. Fans-Mink Lashes Eyeslashes," Jun. 30, 2016, 3 pages, Retrieved from https://web.

(56) References Cited

OTHER PUBLICATIONS archive.org/web/20160630100924/ http:/www.eyelashextensions.com/eyelashes/mink-lashes/volume-fans/glad-lash-signature-5d.html.
Glad Girl: "Glad Lash Signature Double Configuration D Y Eyelashes," Sep. 26, 2024, 3Pages, Retrieved from [https://www.gladgirl.com/products/glad-lash-signature-double-configuration-2d-y-eyelashes?srsltid=AfmBOoqEbsioiLD0iJPG4gdT1JyfJq7Z32u6_9fhODFwjWJV9vRN_Uo&variant=31337154150452].
Glad Girl: "Knot-Free Flare Lashes—Eyelashes," Feb. 24, 2016, 3 Pages, Retrieved from https://web.archive.org/web/20160224231654/http:/www.eyelashextensions.com/knot-free-medium-10-hair-7261.html.
Gladgirl: "W Lashes," Mar. 23, 2016, 2 Pages, Retrieved from [https://web.archive.org/web/20160323083727/http:/www.eyelashextensions.com/eyelashes/mink-lashes/w-lashes.html].
Gladgirl: "Glad Lash Belle Strip Lash Application—Under Lash Line Technique," Eyelash Extension Supplies, Jan. 31, 2014, 10 Pages, Retrieved from [https://www.youtube.com/watch?v=6xnLNxbqVKM].
Gladgirl: "Glad Lash Demi Whispy Strip Lash Application—Under Lash Line Technique," Eyelash Extension Supplies, Jun. 3, 2013, 11 Pages, Retrieved from [https://www.youtube.com/watch?v=FpsrXgWQwk].
Gladgirl: "Knot-Free," Mar. 22, 2016, 2 Pages, Retrieved from [https://web.archive.org/web/20160322053913/http:/www.eyelashextensions.com/eyelashes/flare-lashes/knot-free.html].
"Gladgirl: Lash Index," Mar. 10, 2016, 3 Pages, Retrieved from [https://web.archive.org/web/20160310145533/http:/www.eyelashextensions.com/eyelashes.html].
Gladgirl: "Signature 4D," Jun. 27, 2016, 5 Pages, Retrieved from [https://web.archive.org/web/20160627013832/http:/www.eyelashextensions.com/eyelashes/mink-lashes/volume-fans/glad-lash-signature-4d.html].
Gladgirl: "Knot-Free W Lash Off the Tray," Jun. 30, 2016, 5 Pages, Retrieved from [https://web.archive.org/web/20160630041938/ http:/www.eyelashextensions.com/eyelashes/mink-lashes/w-lashes/knot-free-w-lash-off-the-tray.html].
Guglielmo A.D., "The New Way To Apply False Lashes," Stylecaster, Feb. 6, 2015, 2 Pages, Retrieved from [https://web.archive.org/web/20160201132329/ http://stylecaster.com/beauty/false- eyelashes-application-tip/].
Hollyren: "Beautiful Knot Free Flare Eyelashes for Daily Life #H03," Jun. 11, 2016, 4 Pages, Retrieved from [https://web.archive.org/web/20160611120459/ http://www.hollyren.com/Beautiful-Knot-Free-Flare-Eyelashes-For-Daily-Life-H03_215.html].
"Hollyren: False Eyelashes," Jun. 11, 2016, 2 Pages, Retrieved from [https://web.archive.org/web/20160611120415/ http:/www.hollyren.com/all-categories.html].
Hollyren: "Make Beauty Easier, Individual Flare Lashes," Jun. 11, 2016, 3 Pages, Retrieved from https://web.archive.org/web/20160611032519/ http:/www.hollyren.com/Individual-Flare-Lashes_cpid9.
Hollyren: "Make Beauty Easier, Regular Lashes, Beautiful Fashion False Eyelash For Daily Life #A02 products," Jun. 10, 2016, 2 Pages, Retrieved from https://web.archive.org/web/20160610231445/http:/www.hollyren.com/Regular-Lashes_cpid12.
Hollyren: "Make Beauty Easier, Super Soft Faux Mink False Eyelashes products," Apr. 6, 2016, 2 Pages, Retrieved from https://web.archive.org/web/20160406204549/ http:/www.hollyren.com/Faux-Mink-False-Eyelashes_cpid38.
Hollyren: "Make Beauty Easier, Tip Mellow Lashes, Natural Look Tipped Criss Cross False Eyelash #BY05," Jun. 11, 2016, 2 Pages, Retrieved from https://web.archive.org/web/20160611032812/ http:/www.hollyren.com/Tip-Mellow-Lashes_cpid3.
Hollyren: "Natural Look Tipped Criss Cross False Eyelash #BY05," May 29, 2016, 2 Pages, Retrieved from [https://web.archive.org/web/20160529101843/ http:/www.hollyren.com/Natural-Look-Tipped-Criss-Cross-False-Eyelash-BY05_46.html].
Hollyren: "Quotation of EyeLash Extensions 2013," Jul. 12, 2023, 1 Page, Exhibit F-3 Summary Chart, Defendant's Final Invalidity Contentions, United States District Court for the Western District of Texas—Waco Division, Case No. 6:22-cv-00776-ADA-DTG, *Lashify Inc*, v. *Qingdao Lashbeauty Cosmetic Co, Ltd*. d/b/a *Worldbeauty* and *Qingdao Hollyren Cosmetics Co, Ltd*. d/b/a *Hollyren*.
Hollyren: Super Soft Faux Mink False Eyelashes SS03, May 28, 2016, 2 Pages, Retrieved from [https://web.archive.org/web/20160528090621/ http:/www.hollyren.com/Super-Soft-Faux-Mink-False-Eyelashes-SS03_4812.html].
Hollyren: Super Soft Faux Mink False Eyelashes SS06, May 28, 2016, 2 Pages, Retrieved from [https://web.archive.org/web/20160528084206/ http:/www.hollyren.com/Super-Soft-Faux-Mink-False-Eyelashes-SS06_4815.html].
Hollyren: "Super Soft Faux Mink False Eyelashes SS08," Qingdao Hollyren Cosmetics Co., Ltd, May 28, 2016, 02 Pages, Retrieved from [https://web.archive.org/web/20160528094955/ http:/www.hollyren.com/Super-Soft-Faux-Mink-False-Eyelashes-SS08_4817.html].
Hollyren: "Super Soft Faux Mink False Eyelashes SS11" Qingdao Hollyren Cosmetics Co., Ltd, May 28, 2016, 02 Pages, Retrieved from [https://web.archive.org/web/20160528144715/ http:/www.hollyren.com/Super-Soft-Faux-Mink-False-Eyelashes-SS11_4820.html].
Hussh SG: "How to Apply Hussh DIY Lashes," HussshSG video, May 28, 2010, 15 Pages, Retrieved from [https://www.youtube.com/watch?v=AIBSySwqsOY].
I.Envy by Kiss: "Quattro Collection Ad," Hype Hair Magazine, Nov. 2015, vol. 22(8), 1 Page.
I.ENVY: "Knot-Free," Jan. 31, 2015, 2 Pages, Retrieved from [https://web.archive.org/web/20150131220543/ http:/ienvybykiss.com/2013/portfolio-type/knot-free/].
I.ENVY: "Trio Lash-KPECO1UB/02US," Jan. 31, 2015, 2 Pages, Retrieved from [https://web.archive.org/web/20150131220846/ http:/ienvybykiss.com/2013/portfolio/trio-lash-kpec01ub02ub/].
Japonesque: "Sectional 4 Lashes," Aug. 10, 2014, 1 Page, Retrieved from [https://web.archive.org/web/20140810125817/ http:/japonesque.com/lashes-brows/false-lashes/eyelash-sectional-4].
Japonesque: "Sectional 4 Lashes," Oct. 2, 2024 4 Pages, Retrieved from [https://www.amazon.com/JAPONESQUE-ZM-410-Sectional-4-Eyelashes/dp/B0038R1WOU/ref=cm_cr_arp_d_pl_foot_top?ie=UTF8].
Japonesque: "False Lashes—Lashes & Brows", Aug. 8, 2014, Retrieved from [https://web.archive.org/web/20140808235016/ http:/japonesque.com/lashes-brows/false-lashes].
Jocelyn-Marcial: "How to Apply Strip Lashes Underneath VS on Top," Jocelyn Marcial Video, Mar. 17, 2017, 24 Pages, Retrieved from [https://www.youtube.com/watch?v=lu_ck8K4otw].
Kiss: "I Envy Knot Free Ultra Black Short (KPE04UB), Madame Madeline," Oct. 1, 2015, 3 pages, Retrieved from https://web.archive.org/web/20151001102530/https:/madamemadeline.com/online_shoppe/proddetail.asp?prod=mmKPE04UB.
Kiss: "Ever EZ Lashes Single Pack," The Wayback Machine, Jan. 1, 2015, 02 Pages, Retrieved from [https://web.archive.org/web/20150101185551/ http://www.kissusa.com/lashes/ever_ez_lashes/everez_lashes_single_pack#. VKWYPnbP1qY].
Kiss: "Ever-EZ Kiss Premium Lashes 03, Ever-EZ Lashes by Kiss—Madame Madeline," Jul. 8, 2016, 2 Pages, Retrieved from https://web.archive.org/web/20160708044512/https:/www.madamemadeline.com/online_shoppe/proddetail.asp?prod=mmKPL03.
Kiss: "I Envy by Kiss—How to Apply Individual Lashes," Nails R US Beauty Supply Ltd., Aug. 27, 2017, 17 Pages, Retrieved from [https://www.youtube.com/watch?v=qPLNB_WDJGw].
KISS Looks So Natural False Eyelashes, Shy, 14 mm, 1 Pair, Sep. 26, 2024, 4 pages, Retrieved from https://www.walmart.com/ip/KISS-Looks-So-Natural-False-Eyelashes-Shy/34400580.
Kiss: "Strip Lashes Mul, "Haute Couture Multi Pack Lashes Wink, Sep. 26, 2014, 01 Page, Retrieved from [https://web.archive.org/web/20140926011512/ http://www.kissusa.com/lashes/haute_couture/haute_couture_lash_multipack#. VCS-QnbP2Uk].

(56) References Cited

OTHER PUBLICATIONS

Lash'em: "Mink Fur & Horse Mane Eyelashes," Apr. 28, 2014, 02 Pages, Retrieved from [https://web.archive.org/web/20140428032020/ http://www.lashemlashes.com/services.html].
Long Tai LT-004 Lashes: "Exhibit A-39, Defendant's Final Invalidity Contentions," Jul. 12, 2023, United States District Court for the Western District of Texas—Waco Division, Case No. 6:22-cv-00776-ADA-DTG, *Lashify Inc*, v. *Qingdao Lashbeauty Cosmetic Co, Ltd*. d/b/a *Worldbeauty* and *Qingdao Hollyren Cosmetics Co, Ltd*. d/b/a *Hollyren*, 1 Page.
Madame Madaline: "Ardell Duralash Naturals Long Length," Sep. 10, 2025, 3 Pages, Retrieved from [https://web.archive.org/web/20150910130146/https:/www.madamemadeline.com/online_shoppe/proddetail.asp?prod=adl_I].
Madame Madaline: Ever EZ Kiss Premium Lashes, Kiss Premium Eyelashes, Madame Madaline, Apr. 10, 2016, 05 Pages, Retrieved from [https://web.archive.org/web/20160410103057/https:/www.madamemadeline.com/online_shoppe/products.asp?cat=EVER+EZ+LASHES+by+Kiss].
Madame Madeline: "Kiss I-Envy Au Naturale," Sep. 6, 2015, 05 Pages, Retrieved from [https://web.archive.org/web/20150906170057/https:/www.madamemadeline.com/online_shoppe/products.asp?cat=i-ENVY+Strip+Lashes+by+KISS].
Madame Madeline: "Ardell Duralash Knot-Free Double Individual Lashes Long," May 6, 2016, 2 Pages, Retrieved from [https://web.archive.org/web/20160506050354/https:/www.madamemadeline.com/online_shoppe/proddetail.asp?prod=mm61496].
Madame Madeline: "Ardell Duralash Knot-Free Double Individual Lashes Medium," May 6, 2016, 3 Pages, Retrieved from [https://web.archive.org/web/20160506015523/https:/www.madamemadeline.com/online_shoppe/proddetail.asp?prod=mm61485].
Madame Madeline: "Ardell Duralash Knot-Free Double Individual Lashes Short," May 6, 2016, 3 Pages, Retrieved from [https://web.archive.org/web/20160506053149/https:/www.madamemadeline.com/online_shoppe/proddetail.asp?prod=mm61484].
Madame Madeline: "Ardell Duralash Naturals Combo Pack," Sep. 10, 2015, 3 Pages, Retrieved from [https:// web.archive.org/web/20150910090349/https:/www.madamemadeline.com/online_shoppe/proddetail. asp?prod=mm65063].
Madame Madeline: "Ardell Duralash Naturals Medium Length," Sep. 10, 2015, 3 Pages, Retrieved from [https://web.archive.org/web/20150910130347/https:/www.madamemadeline.com/online_shoppe/proddetail.asp?prod=adl_ml].
Madame Madeline: "Ardell Duralash Naturals Short Length," Sep. 10, 2015, 3 Pages, Retrieved from [https://web.archive.org/web/20150910130042/https:/www.madamemadeline.com/online_shoppe/proddetail.asp?prod=adl_s].
Madame Madeline: "Ardell Duralash Naturals Starter Kit," Sep. 10, 2015, 3 Pages, Retrieved from [https://web.archive.org/web/20150910093438/https:/www.madamemadeline.com/online_shoppe/proddetail.asp?prod=mm240462].
Madame Madeline: "Ardell False Eyelashes Accessories, Invisi Bands Lash Lites Eyelashes," False Eyelashes, Apr. 10, 2016, 05 Pages, Retrieved from [https://web.archive.org/web/20160410124330/https:/www.madamemadeline.com/online_shoppe/products.asp?cat=Ardell+InvisiBands+%26+LashLites+Eyelashes].
Madame Madeline: "Ardell InvisiBands Demi Luvies," Ardell InvisiBands & LashLites Eyelashes, Sep. 10, 2015, 03 Pages, Retrieved from [https://web.archive.org/web/20150910131057/https:/www.madamemadeline.com/online_shoppe/proddetail.asp?prod=ail_dlv].
Madame Madeline: "Ardell InvisiBands Demi Wispies (New Packing)," Ardell InvisiBands & LashLites Eyelashes, Sep. 10, 2015, 03 Pages, Retrieved from [https://web.archive.org/web/20150910130919/https:/www.madamemadeline.com/online_shoppe/proddetail.asp?prod=mm65012].
Madame Madeline: "Ardell Invisibands Wispies (New Packaging)," Sep. 21, 2015, 3 Pages, Retrieved from [https://web.archive.org/web/20150921002822/https:/www.madamemadeline.com/online_shoppe/proddetail.asp?prod=ail_wn].
Madame Madeline: Ardell Invisibands Wispies, Sep. 10, 2015, 3 Pages, Retrieved from [https://web.archive.org/web/20150910130131/https:/www.madamemadeline.com/online_shoppe/proddetail.asp?prod=ail_w].
Madame Madeline: "Ardell Lash Trios Individual Long Black," Jul. 16, 2017, 3 Pages, Retrieved from [https://web.archive.org/web/20170720061842/https:/www.madamemadeline.com/online_shoppe/products.asp?cat=Ardell+Individual+Trios+Lashes].
Madame Madeline: "Ever-Ez Kiss Premium Lashes 11," Madame Madeline, Jul. 8, 2016, 03 Pages, Retrieved from [https://web.archive.org/web/20160708105446/https:/www.madamemadeline.com/online_shoppe/proddetail.asp?prod=mmKPL01].
Madame Madeline: "I.Envy Individual Lashes Classic Flare Combo (KPE03)," Sep. 11, 2015, 5 Pages, Retrieved from [https://web.archive.org/web/20150911044752/https:/www.madamemadeline.com/online_shoppe/products.asp?cat=i-ENVY+Individual+Lashes+by+KISS].
Madame Madeline: "I.Envy Individual Lashes Knot Free Combo KPE06," Sep. 11, 2015, 3 Pages, Retrieved from [https://web.archive.org/web/20150911110942/https:/madamemadeline.com/online_shoppe/proddetail.asp?prod=mmKPE06].
Madame Madeline: "I-Envy Individual Lashes Trio Medium (KPEC02)," Sep. 27, 2015, 3 Pages, Retrieved from [https://web.archive.org/web/20150927140415/https:/www.madamemadeline.com/online_shoppe/proddetail.asp?prod=mmKPEC02].
Madame Madeline: "I.Envy Individual Lashes Trio Short (KPEC01)," Sep. 30, 2015, 3 Pages, Retrieved from [https://web.archive.org/web/20150930045649/https:/madamemadeline.com/online_shoppe/proddetail.asp?prod=mmKPEC01].
Madame Madeline: "I-Envy Individual Lashes Trio Ultra Black Short (KPEC01UB)," Sep. 29, 2015, 3 Pages, Retrieved from [https://web.archive.org/web/20150929123306/https:/madamemadeline.com/online_shoppe/proddetail.asp?prod=mmKPEC01UB].
Madame Madeline: "Japonesque Eyelashes Sectinal 4," Japonesque False Eyelashes, Sep. 10, 2015, 3 Pages, Retrieved from [https://web.archive.org/web/20150910073702/https:/www.madamemadeline.com/online_shoppe /proddetail.asp?prod=jpn410].
Madame Madeline: "Kiss i-Envy Au Naturale Multi-Pack 01 (KPEM08)," Strip Lashes by Kiss-Madame Madeline, Sep. 10, 2015, 02 Pages, Retrieved from [https://web.archive.org/web/20150910075201/https://www.madamemadeline.com/online_shoppe/proddetail.asp?prod=mmKPEM08].
Marilyn: "Ardell False Lashes Including the New Color Impact—Review, Photos and Looks," Mar. 6, 2013, 12 Pages, Retrieved from [https://weheartthis.com/ardell-false-lashes-including-the-new-color-impact-review-photos-and-looks/].
"MATA: Mahkota Tri Angjaya," Jul. 12, 2016, 1 Page, Retrieved from [https://web.archive.org/web/20160712154019/http:/www.mata-lashes.com].
MATA: "Process of Making Flare Eyelashes," PT. Mahkota Tri Angjaya, Nov. 12, 2015, 16 Pages, Retrieved [https://www.youtube.com/watch?v=UuJ3WNqiZWM].
Office Action for Chinese Patent Application No. 202110625150.1, mailed Aug. 30, 2024, 27 Pages.
Premier Lashes: "Exhibit A-42, Defendant's Final Invalidity Contentions," Jul. 12, 2023, United States District Court for the Western District of Texas—Waco Division, Case No. 6:22-cv-00776-ADA-DTG, *Lashify Inc*, v. *Qingdao Lashbeauty Cosmetic Co, Ltd*. d/b/a *Worldbeauty* and *Qingdao Hollyren Cosmetics Co, Ltd*. d/b/a *Hollyren*, 4-5 Pages.
Pretty Casual: "Lashtite Glue DIY Eyelash Extensions—Apply Under My Lashes For A More Natural Look!," Mar. 26, 2016, 42 Pages, Retrieved from [https://www.youtube.com/watch?v=Td6Bi9aVmeQ].
Queenie-Chan: "Invisible Eyelash Extension Method—How to Apply False Eyelashes in a Special Way," BeautyQQ, Aug. 9, 2009, 20 Pages, Retrieved from [https://www.youtube.com/watch?v=lal-QMuLByU].
Shu Uemura: "Slim Partial," Dec. 14, 2011, 1 Page, Retrieved from [https://web.archive.org/web/20111214144618/ http:/www.shuuemura-usa.com/_us/_en/accessories/false-eyelashes/accent/slim-partial.htm].

(56) References Cited

OTHER PUBLICATIONS

Steale02: "How to Apply Individual Lashes," Steale02 Video, Apr. 5, 2010, 35 Pages, Retrieved from [https://www.youtube.com/watch?v=9X84CUIWqgo].
Toni Valentine: "How to Apply Individual Lashes," Mar. 16, 2013, 101 Pages, Retrieved from [https://www.youtube.com/watch?v=aLHE2SqzlO].
Walmart: Customer Reviews for KISS Looks So Natural, False Eyelashes, Shy, 14 mm, 1 Pair, 02 Pages, [Retrieved on Oct. 3, 2024], Retrieved from [https://www.walmart.com/reviews/product/34400580].
Wayback Machine: "Slim Partial—Accent Lashes by Shu Uemura Art of Beauty", Feb. 1, 2013, p. 1, Retrieved from https://web.archive.org/web/20130201021908/ http:/www.shuuemura-usa.com/_us/_en/accessories/false-eyelashes/accent/slim-partial.htm.
"WorldBeauty: Knot Free Flare Lashes," Exhibit A-44, Defendant's Final Invalidity Contentions, Jul. 12, 2023, 1 Page, United States District Court for the Western District of Texas—Waco Division, Case No. 6:22-cv-00776-ADA-DTG, *Lashify Inc*, v. *Qingdao Lashbeauty Cosmetic Co, Ltd*. d/b/a *Worldbeauty* and *Qingdao Hollyren Cosmetics Co, Ltd*. d/b/a *Hollyren*.
"WorldBeauty: Knot Free Flare Lashes", Aug. 17, 2012, 3Pages, Retrieved from [https://web.archive.org/web/20120817103827/ http:/www.worldbeautylashes.com:80/category/flare-eyelashes.html].
Office Action for Japanese Patent Application No. 2023149877, mailed Jul. 1, 2024, 10 pages.

* cited by examiner
† cited by third party

ARTIFICIAL LASH EXTENSIONS

CROSS-REFERENCE TO RELATED APPLICATIONS

This application is a continuation of U.S. patent application Ser. No. 17/720,222, filed Apr. 13, 2022, which is a continuation of U.S. patent application Ser. No. 17/003,874, filed Aug. 26, 2020, now U.S. Pat. No. 11,330,856, issued May 17, 2022, which is a continuation of U.S. patent application Ser. No. 16/556,518, filed Aug. 30, 2019, now U.S. Pat. No. 11,234,472, issued Feb. 1, 2022; which is a continuation of U.S. patent application Ser. No. 15/968,361 filed May 1, 2018, now U.S. Pat. No. 10,660,388 issued May 26, 2020; which is a continuation of International Application No. PCT/US17/44217 filed Jul. 27, 2017; which claims the benefit of U.S. Provisional Application No. 62/368,116 filed Jul. 28, 2016; the contents of all of which are hereby incorporated by reference in their entirety herein. This application is also related to U.S. patent application Ser. No. 18/126,908, filed Mar. 27, 2023, U.S. Patent Application No. U.S. patent application Ser. No. 17/342,355, filed Jun. 8, 2021, now U.S. Pat. No. 11,253,020 issued Feb. 22, 2022, U.S. patent application Ser. No. 17/003,853, filed Aug. 26, 2020, now U.S. Pat. No. 11,219,260 issued Jan. 11, 2022, U.S. patent application Ser. No. 16/883,925, filed May 26, 2020, now U.S. Pat. No. 11,330,855, issued May 17, 2022, U.S. patent application Ser. No. 16/575,894, filed Sep. 19, 2019, now U.S. Pat. No. 10,721,984, issued on Jul. 28, 2020, U.S. Design Application No. 29/726,244, filed Mar. 2, 2020, now U.S. Pat. No. D987,891, issued on May 30, 2023, and U.S. Design Application No. 29/838,278, filed May 11, 2022.

FIELD OF THE INVENTION

Various embodiments concern artificial eyelashes and, more specifically, clusters of artificial eyelash extensions that can be applied to the underside of an individual's natural eyelashes.

BACKGROUND

Eyelash extensions have conventionally been used to enhance the length, thickness, and fullness of natural eyelashes. Eyelash extensions, however, must be applied to an individual's natural eyelashes one by one to avoid having the eyelash extensions stick together. Consequently, lash extension services can cost hundreds of dollars depending on the type and number of lashes used, the skill of the cosmetician, and the venue where the eyelash extensions are applied. It usually takes an experienced cosmetician one to two hours to attach a full set of eyelash extensions.

Clusters of artificial lashes have conventionally been used to enhance the length, thickness, and fullness of an individual's natural eyelashes. However, each cluster must be applied to the individual's eyelashes individually in order to avoid having the clusters of artificial lashes stick together and to ensure multiple clusters are evenly distributed across the width of the individual's lash line.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

BRIEF DESCRIPTION OF THE DRAWINGS

Various embodiments are illustrated by way of example and not limitation in the accompanying drawings, in which like references indicate similar elements. Various objects, features, and characteristics of the present invention will become more apparent to those skilled in the art from a study of the Detailed Description in conjunction with the accompanying drawings.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Conventional eyelash extensions (or simply "lash extensions") are individually adhered to an individual's eyelashes one-by-one in order to prevent the eyelash extensions from sticking together. However, because the average individual might have anywhere from thirty to eighty lashes per eye, the application process can take several hours to attach a full set of eyelash extensions.

Introduced here, therefore, are techniques for creating clusters of artificial lash extensions that can be applied to an individual's natural eyelashes. Clusters of artificial lashes include multiple artificial hairs made of natural materials (e.g., silk or authentic mink hair) or synthetic materials (e.g., acrylic resin, polybutylene terephthalate (PBT), or synthetic mink hair made of polyester). A cluster of artificial lashes generally includes approximately 10 to 30 artificial hairs (and preferably 10 to 20 artificial hairs). Clusters of artificial lashes are initially formed using, for example, a hot melt method in which artificial lashes are heated. For example, in some embodiments linear artificial lashes are heated at one end such that they begin to fuse to one another at that end, while in other embodiments linear artificial lashes are heated near a central point and folded underneath one another. Clusters of artificial lashes have conventionally been made available only to professional lash technicians and cosmeticians.

Figure 1:
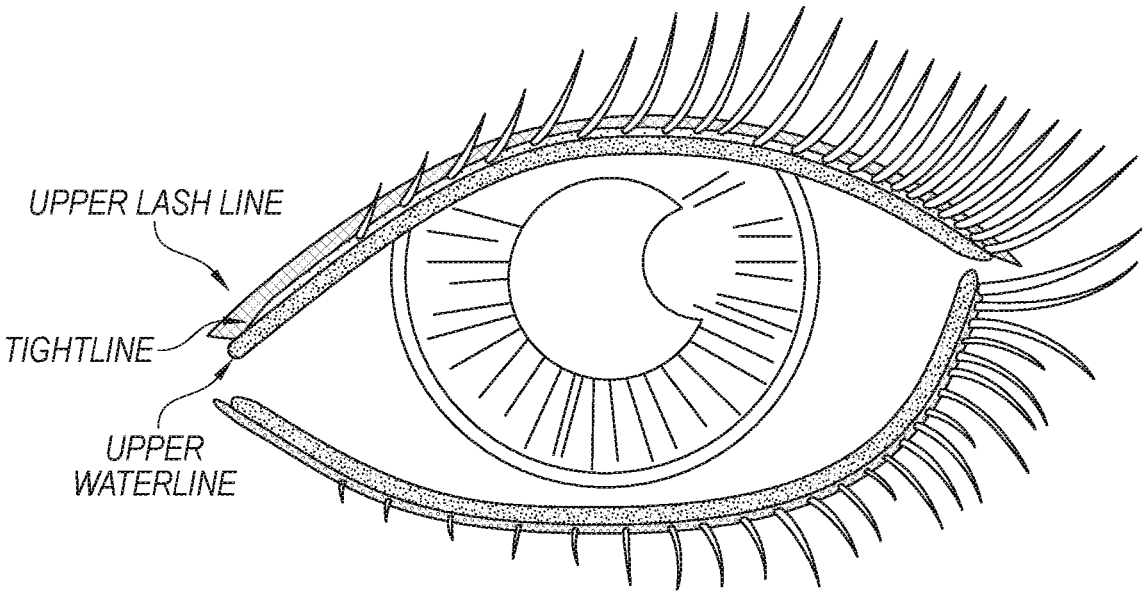
FIG. 1 depicts the upper tightline, upper lash line, and upper waterline of an eyelid.

Multiple clusters can then be fused together to form a bundle (also referred to as a "lash fusion") that can be applied along the upper tightline in a single motion. As shown in FIG. 1, the upper tightline is interposed between the upper lash line and the upper waterline. While certain embodiments have been described in the context of lash fusions that include multiple clusters, those skilled in the art will recognize that a lash fusion could also include a series of individual artificial hairs that are connected to one another.

More specifically, a lash fusion can include multiple clusters that are fused together near the inner ends of the artificial lashes (also referred to as the "base" of the lash fusion) to form a straight line of artificial hairs that can be placed underneath an individual's natural lashes. For example, the multiple clusters can be fused together (e.g., via a heat seal process) approximately 1-5 millimeters (mm) above the base via crisscrossing artificial hairs. In some embodiments, the multiple clusters are fused together approximately 1.5-2.5 mm above the base. The distance from the base at which fusing occurs may depend on the desired fan-out of the artificial lashes (e.g., shorter distances may cause a larger fan-out). Adjacent clusters can be secured to one another when the intersecting portions of the crisscrossing artificial hairs are fused together. Such a technique allows a set of multiple lash fusions to appear seamless and blend in with an individual's natural lashes.

The base of the lash fusion (i.e., where the multiple clusters are fused together) is intended to be affixed to an individual's natural lashes. The lash fusion may be approximately 4-8 mm wide. A lash fusion could include 3-10, 3-7, 5-10, 5-7, or 4-6 clusters. Accordingly, a lash fusion could include 30-150, 30-120, or 30-90 individual artificial hairs.

A set of multiple lash fusions can then be formed by arranging the multiple lash fusions next to one another in a form that matches the curvature of the upper tightline along the base of an eyelid. While the multiple lash fusions are typically not connected to one another (e.g., are not fused together using heat, an adhesive, etc.), the entire set can be applied to the underside of the individual's natural lashes in a single motion. A set could include 3-8, 3-5, 5-8, or 4-6 lash fusions. Accordingly, a set could include 150-360 individual artificial hairs.

The number of lash fusions in a set may vary. In fact, because the multiple lash fusions are typically not secured to one another, an individual could decide to apply part of a set (e.g., five lash fusions rather than six lash fusions) based on the desired density.

Density of the artificial hairs may vary across the width of the eyelid. In some embodiments the artificial hairs are distributed evenly across the entire tightline (i.e., each cluster/lash fusion can include a substantially similar number of artificial lashes), while in other embodiments the artificial hairs are more densely populated in certain area(s) of the tightline (i.e., some clusters/lash fusions may include fewer artificial lashes than others). For example, density may be lower along the outer edge opposite the tear duct.

An adhesive may be applied to the top of each lash fusion within a set during the manufacturing process, which enables an individual to easily apply the set of lash fusions directly to the underside of the individual's eyelashes rather than to the individual's eyelid. Additionally or alternatively, the individual could apply an adhesive before applying the set of lash fusions to the individual's natural eyelashes. For example, the individual may apply an adhesive to the set of lash fusions before applying the set of lash fusions to the natural eyelashes. As another example, the individual could apply an adhesive directly to the natural eyelashes. The adhesive could be a waterproof glue or mascara.

Terminology

Brief definitions of terms, abbreviations, and phrases used throughout this application are given below.

Reference to "one embodiment" or "an embodiment" means that a particular feature, structure, or characteristic described in connection with the embodiment is included in at least one embodiment of the disclosure. The appearances of the phrase "in some embodiments" are not necessarily referring to the same embodiment, nor are they necessarily referring to separate or alternative embodiments that are mutually exclusive of one another.

The terms "connected," "coupled," or any variant thereof includes any connection or coupling between two or more elements, either direct or indirect. The coupling or connection between the elements can be physical, logical, or a combination thereof. For example, two components may be coupled directly to one another or via one or more intermediary channels/components. The words "associate with," meanwhile, mean connecting or relating objects, items, etc.

System Topology Overview

Figure 2:
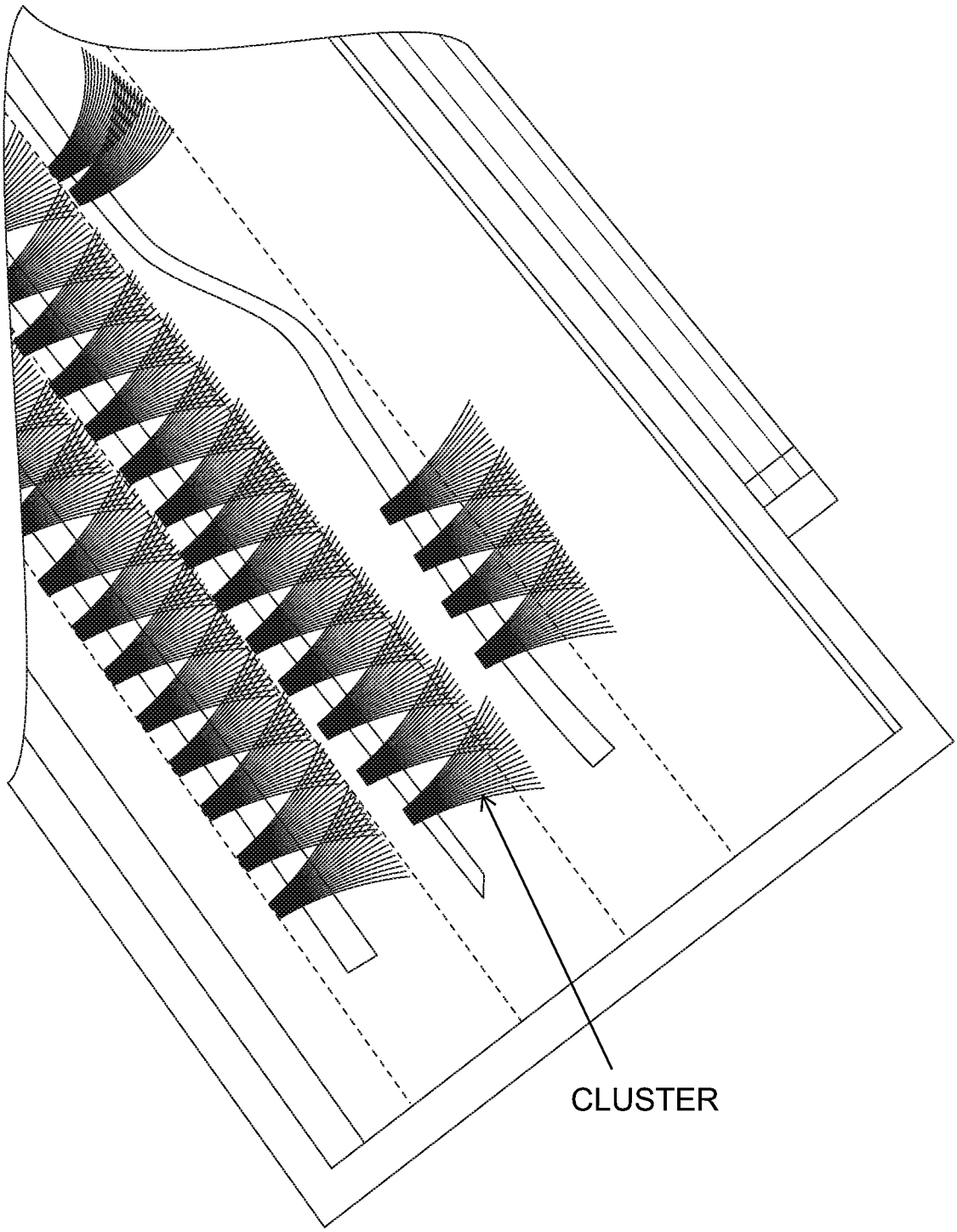
FIG. 2 depicts clusters of artificial lashes that can be used by professional lash technicians and cosmeticians.

FIG. 2 depicts clusters of artificial lashes that can be used by professional lash technicians and cosmeticians. Each cluster of artificial lashes includes multiple artificial hairs that consist of natural materials (e.g., silk or authentic mink hair) or synthetic materials (e.g., acrylic resin, PBT, or synthetic mink hair made of polyester).

Clusters of artificial hairs typically include 10 to 30 hairs that are heated (e.g., as part of a hot melt process) and then secured to one another. For example, in some embodiments linear artificial lashes are heated at one end such that they begin to fuse to one another at that end, while in other embodiments linear artificial hairs are heated near a central point and folded underneath one another.

In some embodiments, some or all of the artificial hairs within a cluster may be tied to a support thread (i.e., knotted). The artificial hairs may be tied by any such means, such as a slip knot that prevents horizontal spreading of the cluster.

Figure 3A:
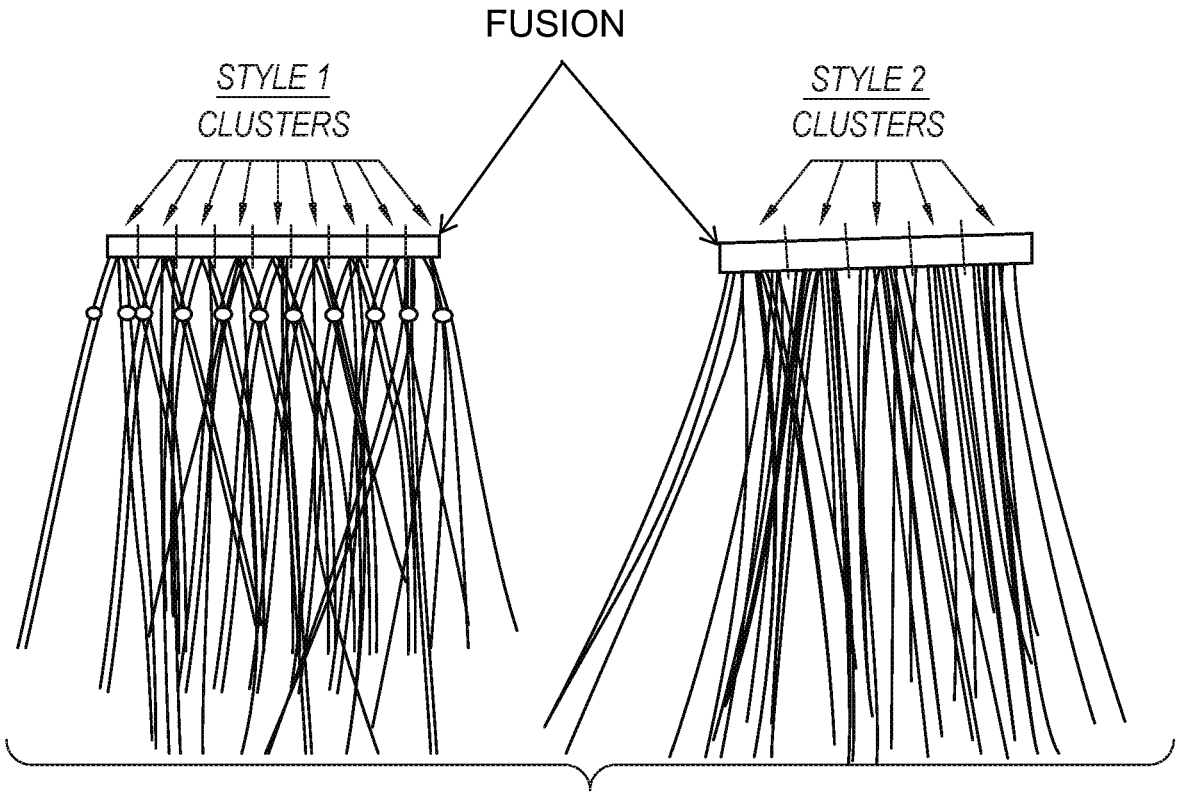
FIG. 3A depicts how multiple clusters of artificial lashes can be connected to form a bundle (also referred to as a "lash fusion").

FIG. 3A depicts how multiple clusters of artificial lashes can be connected to form a bundle (also referred to as a "lash fusion"). More specifically, the lash fusion can include multiple clusters that are fused together near the base to form a straight line of artificial hairs that can be applied along the upper tightline.

For example, the multiple clusters can be fused together (e.g., via a heat seal process) approximately 1-5 mm above the base via crisscrossing artificial hairs. In some embodiments, the multiple clusters are fused together approximately 1.5-2.5 mm above the base. Adjacent clusters can be secured to one another when the intersecting portions of the crisscrossing artificial hairs are fused together. Such a technique allows a set of multiple lash fusions to appear seamless and blend in with an individual's natural lashes.

The intersecting portions of the crisscrossing artificial hairs could also be connected using an adhesive (i.e., rather than being fused together via a hot melt process). In such embodiments, the multiple clusters may be exposed to a curing assembly (e.g., a heater, dryer, or light source) that causes the adhesive to solidify. Artificial lashes made of natural materials (e.g., human or authentic mink hair) are typically connected using a glue or other adhesive rather than through the hot melt process.

A lash fusion could include 3-10, 3-7, 5-10, 5-7, or 4-6 clusters. Accordingly, a lash fusion could include 30-90 individual artificial hairs. Here, for example, a first style of lash fusion includes nine clusters, while a second style of lash fusion includes five clusters.

Note, however, that both styles could include the same number of artificial lashes. For example, the first style of lash fusion may include nine clusters of five artificial lashes each, while the second style of lash fusion may include five clusters of nine artificial lashes each. Both styles could also include different numbers of artificial lashes (e.g., the first style may include a higher density of artificial lashes, and thus be more appropriate for placement near the tear duct).

Lash fusions may be 4-8 mm wide, though embodiments are often 5-6 mm wide. This is much wider than conventional clusters (which are 1.5-2 mm wide), and thus provide greater coverage along the eyelid.

Figure 3B:
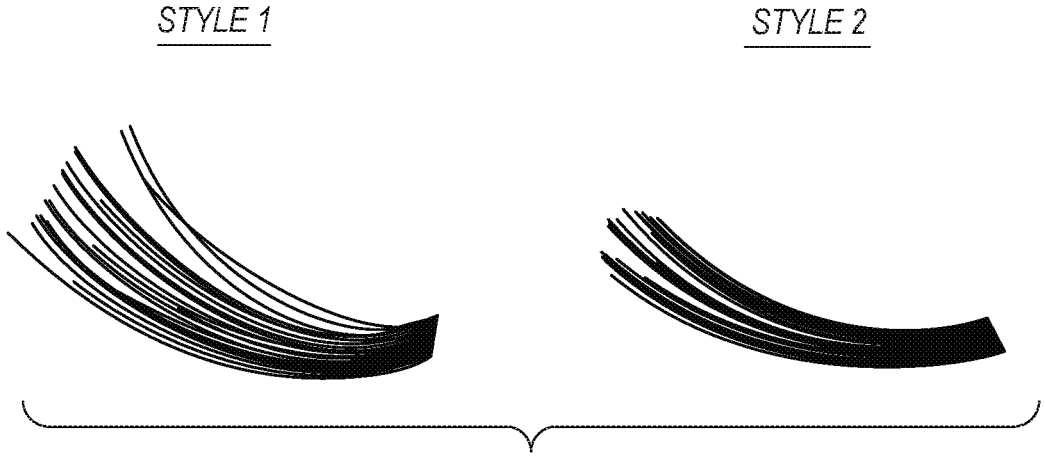
FIG. 3B is a side view of two different styles of lash fusion.

FIG. 3B is a side view of two different styles of lash fusion. The multiple clusters of each lash fusion can be fused to one another (e.g., during a hot melt process). Such a design provides several advantages over conventional clusters of lash extensions.

For example, because the multiple clusters can be heat sealed to one another, the total height at the base of the lash fusion is only 0.05-0.15 mm. Conventional clusters, meanwhile, use a string at the base to connect the artificial hairs to one another. But the presence of the string causes the total height at the base of the cluster to exceed 0.3 mm (e.g., typically 0.3-0.7 mm).

Moreover, the lash fusions described here have no quantifiable weight. Therefore, the lash fusions can more easily adhere to an individual's natural lashes and remain secured for longer periods of time. Again, the presence of the string causes conventional clusters to have a quantifiable weight that affects how they must be adhered to the individual's natural lashes.

Figure 3C:
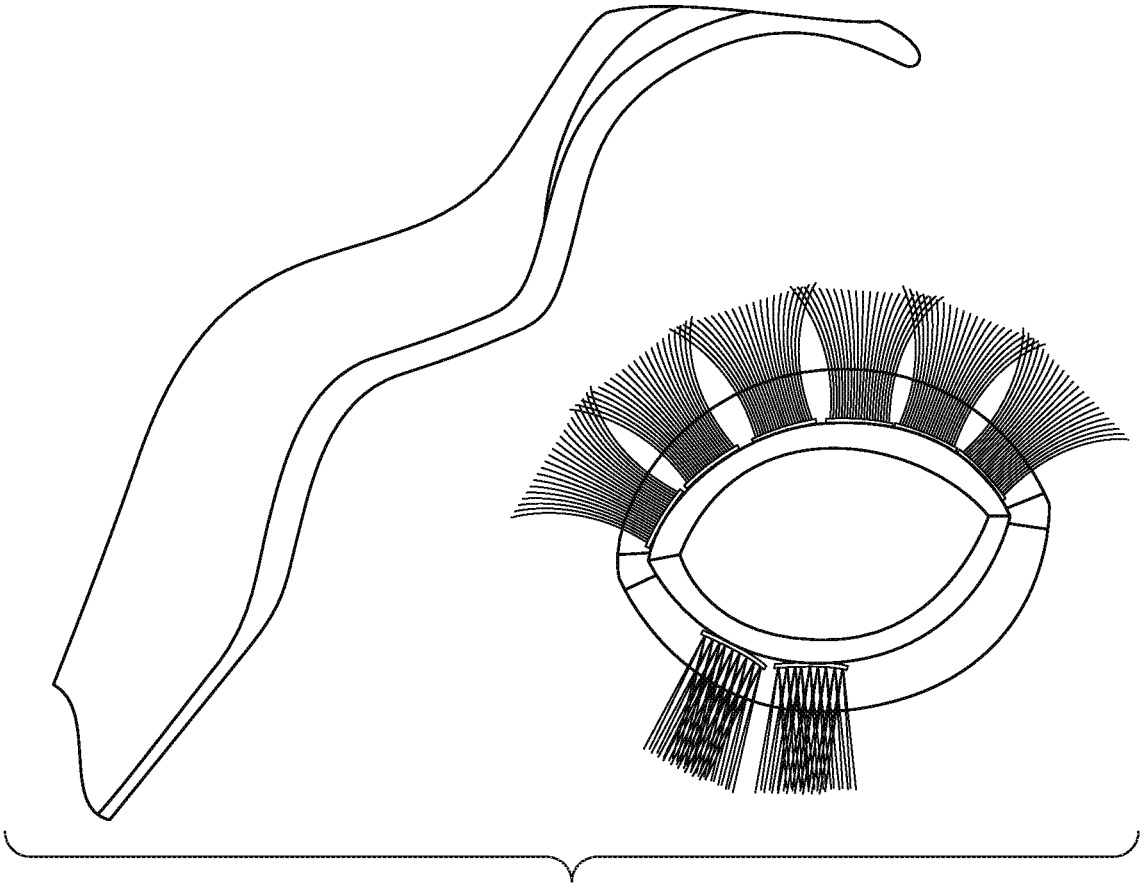
FIG. 3C illustrates how a set of multiple lash fusions can be secured to an individual's lashline in a single motion.

FIG. 3C illustrates how a set of multiple lash fusions can be secured to an individual's lashline in a single motion. A set can include multiple lash fusions that are arranged to match the curvature of the upper tightline of an eyelid. For example, multiple lash fusions may be arranged such that the inner ends (i.e., the bases) form a concave shape that substantially complements the universal tightline of nearly any human eye. In some embodiments, sets preferably include five to seven distinct clusters of artificial lashes. The number of lash fusions within each set (as well as the number of clusters within each lash fusion) may be based on the thickness of the artificial hair used, the desired style of the eyelid on which the set is intended to be affixed, the desired lash density (also referred to as "fullness" of the individual's lashes), etc. As shown in FIG. 3C, the set of lash fusions is aligned with the tightline rather than the lash line, and then affixed to the underside of the individual's natural lashes. Said another way, the set of lash fusions is applied directly to the underside of the natural lashes rather than to the eyelid.

An adhesive can be applied to the top of each lash fusion in the set, which enables an individual to easily apply the set directly to the natural lashes. The individual responsible for applying the set of lash fusions could be a person who affixes the lash fusions to herself or some other person (e.g., a professional lash technician or a cosmetician). In some embodiments, the adhesive is applied when the lash fusions and/or the set are initially manufactured. Additionally or alternatively, the individual could apply an adhesive before attaching the set of lash fusions to the individual's natural lashes.

The adhesive could be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include:

- Arcrylates/ethylhexyl acrylate copolymer, aqua, propylene glycol, ceteareth-25, hydrogenated castor oil, glycerin, phenoxyethanol, 2-bromo-2-nitropropane-1, 3-diol, methylcholoroisothiazolinone, methylisothiazolinone, methylparaben, and optionally a color agent (e.g., black 2 (C177266));
- Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT));
- Chlorine dioxide, p-anisic acid, biotin, lavandula angustifolio oil, propylene glycol, water, 2-ethylhexyl acrylate, and optionally a preservative (e.g., benzalkonium chloride); and
- Acrylate copolymer and water.

Those skilled in the art will recognize that many other adhesive compositions are possible and, in fact, may be desirable for individuals having certain allergies, desiring certain fixation duration (also referred to as "permanency" of the lash extensions), etc.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

Figure 4:
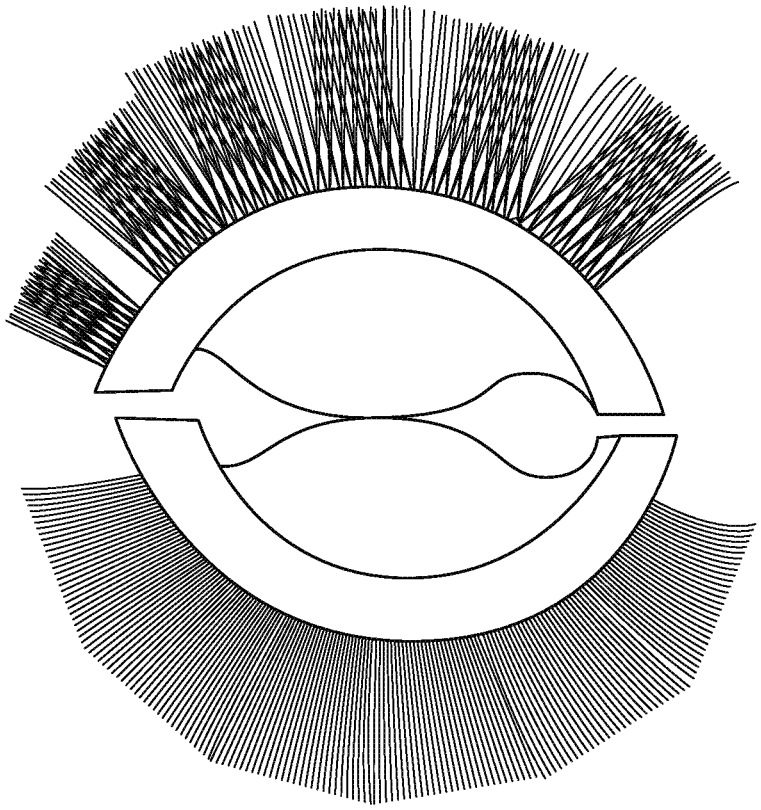
FIG. 4 illustrates how multiple lash fusions within a set can be positioned in a specified arrangement.

FIG. 4 illustrates how multiple lash fusions within a set can be positioned in a specified arrangement. While the multiple lash fusions within the set will typically not be connected to one another, the multiple lash fusions can be arranged such that the set substantially complements the shape of an eyelid. More specifically, the curvature of the multiple lash fusions may substantially match the tightline curvature of an average person. Thus, an entire set of lash fusions may become substantially flush with the lash line when the set is arranged proximate to the tightline. Together, the multiple lash fusions form a set of lash extensions that can be collectively applied in a single motion.

Figure 5:
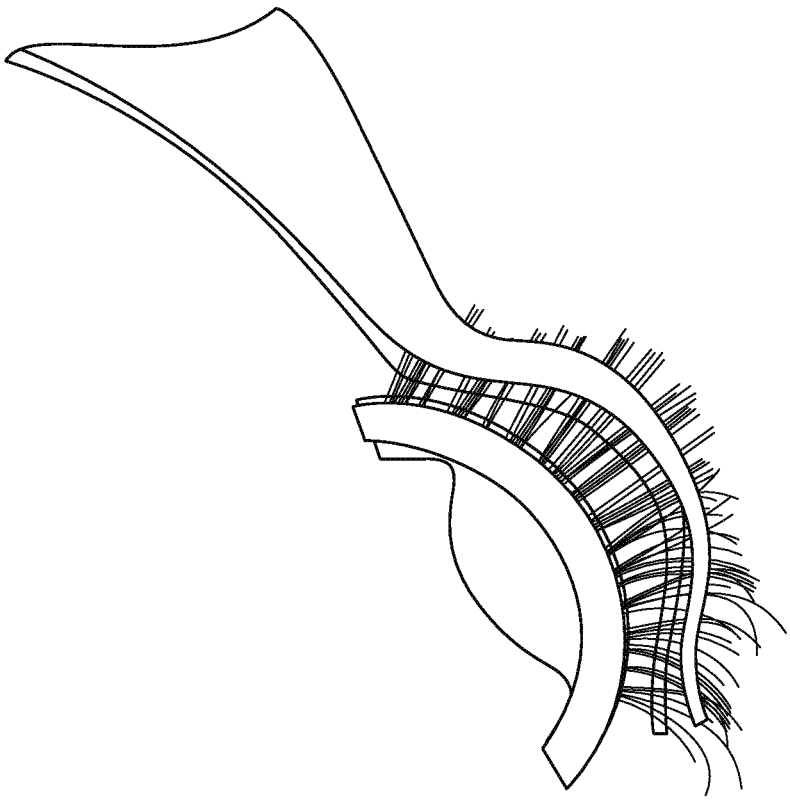
FIG. 5 depicts how the arrangement of the set of lash extensions enables all of the lash fusions to be simultaneously grasped by an applicator.

FIG. 5 depicts how the arrangement of the set of lash extensions enables all of the lash fusions to be simultaneously grasped by an applicator. More specifically, an individual or a healthcare professional, such as a lash technician or cosmetician, can grasp an entire set of lash extensions using the applicator and simultaneously apply the entire set of lash extensions to the individual's natural eyelashes in a single motion.

Figure 6:
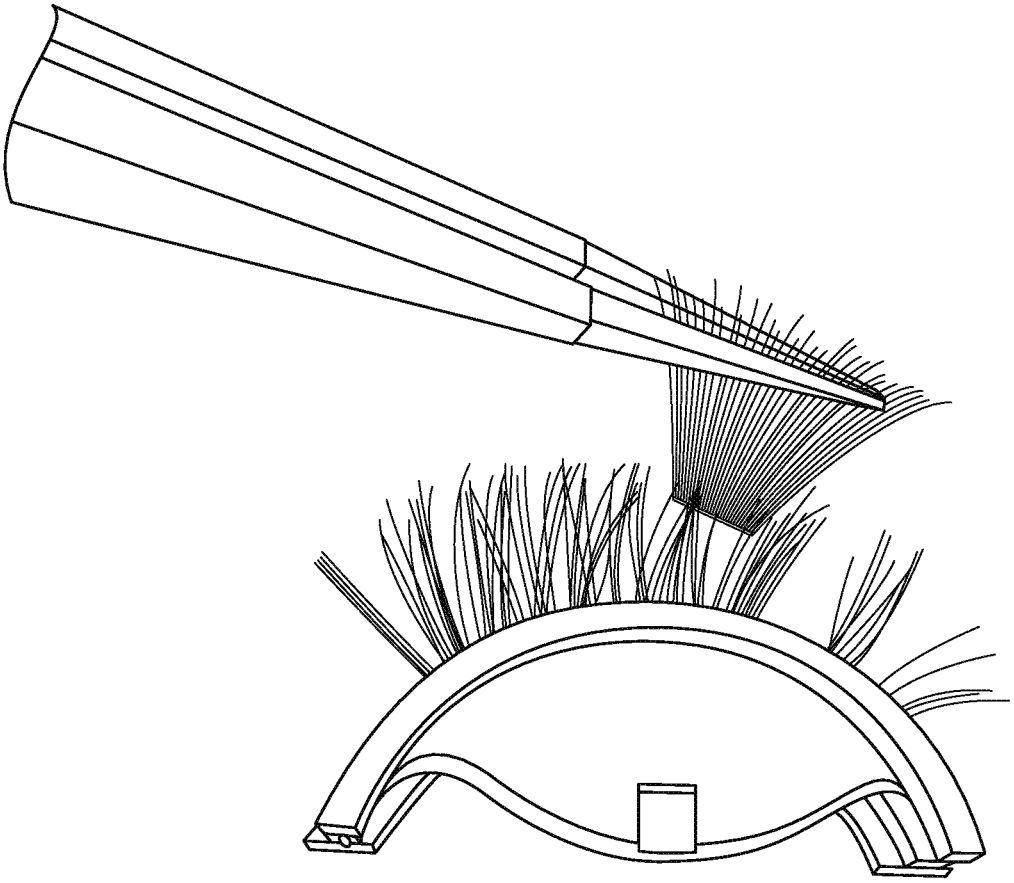
FIG. 6 depicts how the set of lash fusions can be placed underneath an individual's natural lashes, where the plastic represents the individual's eyelid.

FIG. 6 depicts how the set of lash fusions can be placed underneath an individual's natural lashes, where the plastic represents the individual's eyelid. As further described below, an adhesive is applied to the top of each lash fusion in the set of lash extensions. Consequently, the set of lash extensions can be applied directly to the underside of the individual's natural lashes proximate to the tightline, rather than to the eyelid above the lash line.

Figure 7:
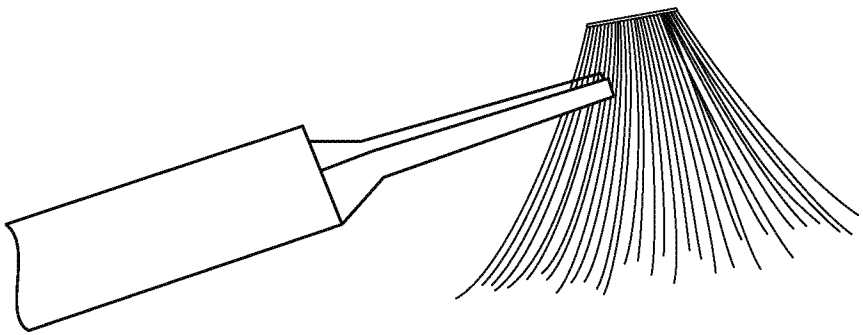
FIG. 7 depicts how an adhesive can be applied to the top of an entire set of lash extensions or to the lash fusions that make up the set.

FIG. 7 depicts how an adhesive can be applied to the top of an entire set of lash extensions or to the lash fusions that make up the set. Additionally or alternatively, an adhesive could be applied to the individual's natural lashes. The adhesive applied to the artificial lash extensions may the same adhesive applied to the individual's natural lashes or a different adhesive.

Such a technique enables the individual to easily apply the set of lash extensions directly to the underside of the individual's natural lashes proximate to the tightline, rather than to the individual's eyelid adjacent to the lash line. While multiple lash fusions are typically arranged with the intention that they be simultaneously grasped and applied to the individual's natural lashes, the individual could also individually apply the lash fusions.

The adhesive could be a semi-permanent glue or mascara. In some embodiments, the adhesive includes an oil-soluble polymer or a water-soluble polymer that helps to enhance adhesion and substantivity of the artificial lash extensions to the individual's natural eyelashes. The adhesive may be a waterproof formulation that allows the set of lash extensions to remain affixed to the individual's natural lashes for longer periods of time (e.g., days, weeks, or months).

Although latex-based adhesives are generally avoided to avoid irritation of the individual's eyelid (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

Figure 8:
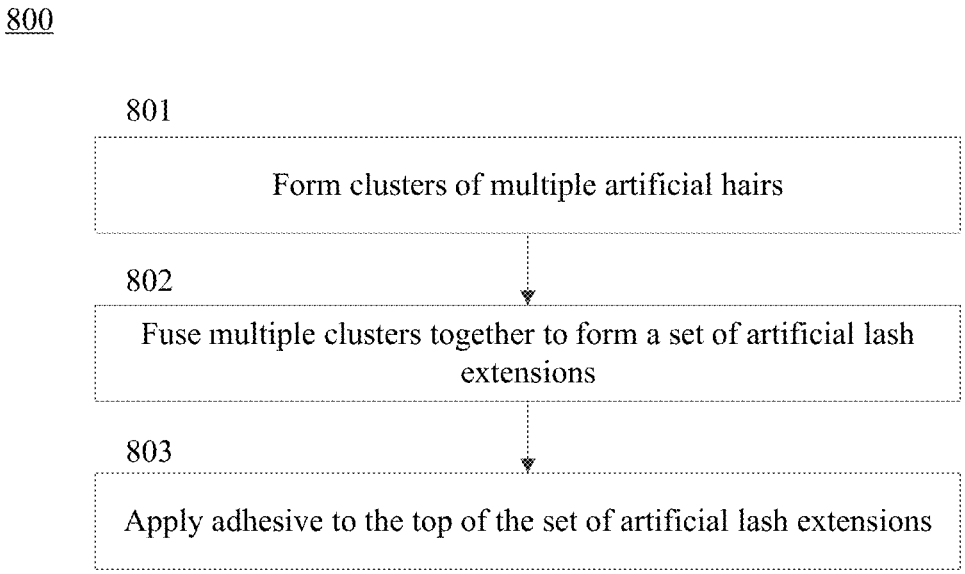
FIG. 8 depicts a flow diagram of a process for manufacturing a lash fusion including multiple clusters of artificial lashes.

FIG. 8 depicts a flow diagram of a process 800 for manufacturing a lash fusion including multiple clusters of artificial lashes. Clusters of artificial lashes are initially formed using, for example, a hot melt method in which artificial hairs are heated and connected to one another (step 801). In some embodiments, linear artificial hairs are heated at one end such that they begin to fuse to one another at that end, while in other. In other embodiments, linear artificial hairs are heated near a central point and folded proximate to the central point (i.e., so that a single artificial hair appears as two artificial lashes). Artificial hairs can then be overlapped (e.g., near the fused end or central fold) to form a cluster.

The hot melt method requires that the multiple artificial hairs be heated to a temperature that is sufficient to cause the individual lashes to begin to melt. For example, artificial hairs made of PBT could be heated to approximately 55-110° C. at one end during a heat seal process (during which the heated ends begin to fuse to one another). Note, however, that clusters could include artificial hairs that consist of natural materials (e.g., silk or authentic mink hair) or synthetic materials (e.g., acrylic resin, PBT, or synthetic mink hair made of polyester). While clusters may include 10 to 90 artificial hairs, most clusters include 10 to 30 artificial hairs.

Multiple clusters can then be connected together to form a lash fusion (step 802). More specifically, the lash fusion can include multiple clusters that are fused together near one end (i.e., the base) to form a straight line of artificial hairs that can be placed underneath an individual's natural lashes.

For example, the multiple clusters could be connected together using a hot melt method substantially similar to the hot melt method used to form the individual clusters. As noted above, the hot melt method requires that the multiple clusters be heated to a temperature that is sufficient to cause the individual lashes to begin to melt. Thus, clusters made of PBT could be heated to approximately 55-110° C. (e.g., 65° C.) near one end. For example, the clusters could be heated approximately 1.5-2.5 mm above the base. As the individual artificial hairs begin to melt, the multiple clusters will connect to one another near the base to form a straight line of artificial hairs, thereby forming a lash fusion.

As another example, the multiple clusters could be connected together using a glue or some other adhesive composed of various substances. In such embodiments, the clusters may be exposed to a curing assembly (e.g., a heater, dryer, or light source) that causes the adhesive to solidify. Thus, after multiple clusters have been formed (e.g., via a hot melt process), the multiple clusters may be glued to one another to form a lash fusion. Artificial lashes made of natural materials (e.g., human or authentic mink hair) are typically connected using a glue or other adhesive rather than through the hot melt process.

An adhesive (e.g., a pressure-sensitive adhesive) can then be applied to the top of the lash fusion (step 803). The adhesive may enable an individual to subsequently apply the lash fusion directly to the underside of the individual's natural lashes. Additionally or alternatively, the individual could apply an adhesive before applying the lash fusion to the natural lashes.

In some embodiments, multiple lash fusion are positioned in a specified arrangement to form a set of lash extensions (step 804). For example, 4-6 lash fusions could be arranged such that the inner ends (i.e., the bases) of the lash fusions form a concave shape that substantially complements the tightline of an eyelid. While the lash fusions are typically not connected to one another (e.g., are not fused together using heat, an adhesive, etc.), the entire set could be applied to the underside of the individual's natural lashes in a single motion.

Figure 9:
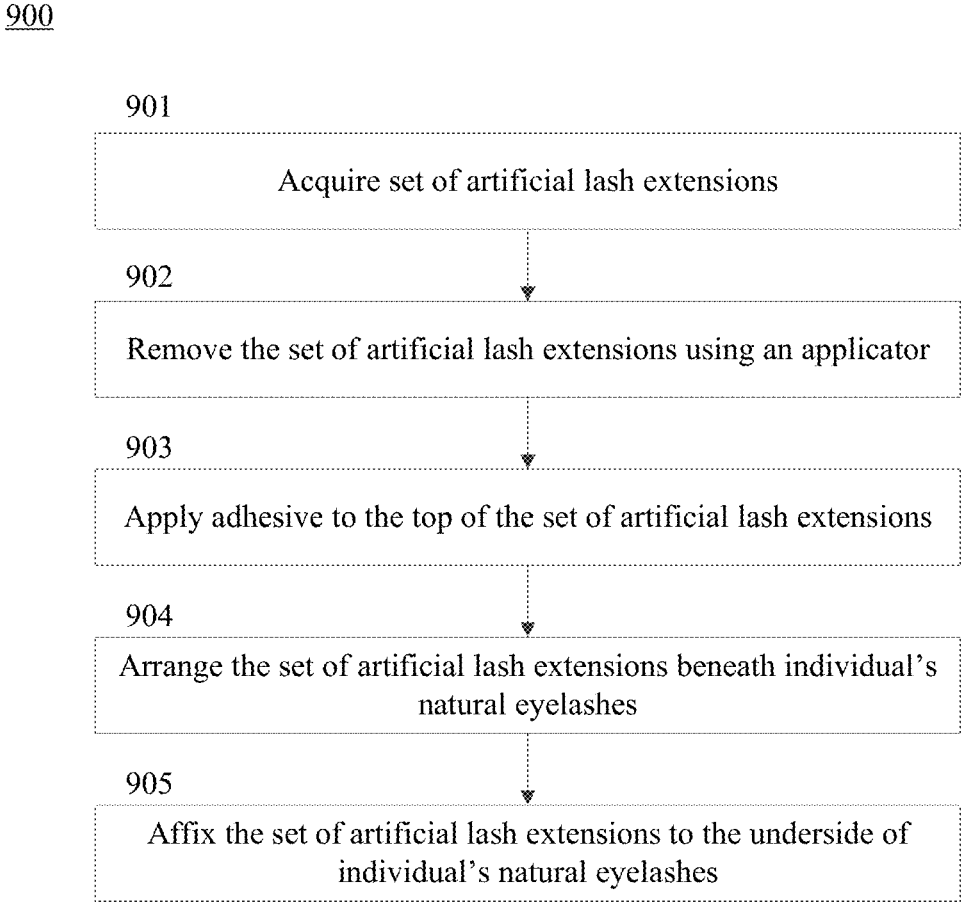
FIG. 9 depicts a flow diagram of a process for applying a set of lash extensions to an individual's natural eyelashes.

FIG. 9 depicts a flow diagram of a process 900 for applying a set of artificial lash extensions to an individual's natural lashes. The set of lash extensions is initially acquired by the individual or a healthcare professional, such as a lash technician or cosmetician (step 901). The set of artificial lash extensions can include multiple lash fusions, each of which is comprised of multiple clusters of artificial lashes. The set of artificial lash extensions can then be grasped using an applicator (step 902). The applicator may be designed so that the entire set of artificial lash extensions (i.e., all of the lash fusions) can be seized and removed (e.g., from a surface to which the set of artificial lash extensions are attached) in a single motion.

In some embodiments an adhesive is applied to the top of each lash fusion in the set of artificial lash extensions (step 903), while in other embodiments an adhesive is applied to the top of each lash fusion in the set of artificial lash extensions during the manufacturing process. The adhesive could be, for example, a waterproof glue or mascara. The set of artificial lash extensions can then be arranged proximate to the tightline beneath the individual's natural lashes (step 904) and affixed to the underside of the individual's natural lashes (step 905), rather than to the individual's eyelid above the lash line.

Unless contrary to physical possibility, it is envisioned that the steps described above may be performed in various sequences and combinations. For instance, an adhesive could be applied to the individual clusters before or after the clusters are formed into lash fusions. Other steps could also be included in some embodiments.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

What is claimed is:

1. An artificial lash extension system comprising:

a plurality of lash extensions, each comprising:

a knotless base;

a plurality of clusters of two or more artificial hairs; and a first adhesive that joins ends of the plurality of clusters to the knotless base;

wherein the knotless bases of the plurality of lash extensions are designed to attach to an underside of natural eyelashes of an eye with a second adhesive.

2. The artificial lash extension system of claim 1, wherein the first adhesive is a cured adhesive.

3. The artificial lash extension system of claim 1, wherein the first adhesive is solidified by heat.

4. The artificial lash extension system of claim 1, wherein the first adhesive is solidified by light.

5. The artificial lash extension system of claim 1, wherein the first adhesive is solidified by drying.

6. The artificial lash extension system of claim 1, wherein the knotless base comprises a base string or fiber.

7. The artificial lash extension system of claim 1, wherein at least some of the artificial hairs in each cluster protrude from the knotless base in different directions.

8. The artificial lash extension system of claim 1, wherein the plurality of clusters protrude from the knotless base in a pattern along the knotless base.

9. The artificial lash extension system of claim 8, wherein the pattern is uniform along the knotless base.

10. The artificial lash extension system of claim 8, wherein a length of the knotless base of each of the plurality of lash extensions is in a range between about 4 millimeters and about 8 millimeters.

11. The artificial lash extension system of claim 8, wherein a length of the knotless base of each of the plurality of lash extensions is in a range between about 5 millimeters and about 6 millimeters.

12. The artificial lash extension system of claim 1, wherein a thickness of the knotless base is less than or equal to 0.15 mm.

13. The artificial lash extension system of claim 1, wherein a thickness of the knotless base is less than 0.3 mm.

14. The artificial lash extension system of claim 1, wherein the artificial hairs are joined to the knotless base by heating in addition to the first adhesive.

15. The artificial lash extension system of claim 1, wherein the two or more artificial hairs comprise a synthetic material.

16. The artificial lash extension system of claim 15, wherein the two or more artificial hairs comprise at least one of polybutylene terephthalate (PBT) or polyester.

17. The artificial lash extension system of claim 1, wherein at least one of the artificial hairs of a first cluster of the plurality of clusters crisscross at least one of the artificial hairs of a second cluster of the plurality of clusters.

18. The artificial lash extension system of claim 1, wherein an artificial hair of a first cluster of the plurality of clusters crisscrosses another artificial hair of the first cluster.

19. A method of manufacturing a plurality of lash extensions, the method comprising, for each of the plurality of lash extensions:

forming a plurality of clusters of two or more artificial hairs; and joining ends of the plurality of clusters to a knotless base with a first adhesive, wherein the knotless bases of the plurality of lash extensions are designed to attach to an underside of natural eyelashes of an eye with a second adhesive.

20. The method of claim 19, wherein the first adhesive is a cured adhesive.

21. The method of claim 19, wherein the first adhesive is solidified by heat.

22. The method of claim 19, wherein the first adhesive is solidified by light.

23. The method of claim 19, wherein the first adhesive is solidified by drying.

24. The method of claim 19, wherein the knotless base comprises a base string or fiber.

25. The method of claim 19, wherein the plurality of clusters are formed and the artificial hairs are joined to the knotless base in a single step.

26. The method of claim 19, wherein at least some of the artificial hairs in each cluster protrude from the knotless base in different directions.

27. The method of claim 26, wherein the plurality of clusters protrude from the knotless base in a pattern along the knotless base.

28. The method of claim 27, wherein a length of the knotless base of each of the plurality of lash extensions is in a range between about 4 millimeters and about 8 millimeters.

29. The method of claim 19, wherein a thickness of the knotless base is less than 0.3 mm.

30. The method of claim 19, wherein the artificial hairs of each cluster are formed of a synthetic material comprising at least one of polybutylene terephthalate (PBT) or polyester.

* * * * *